US007629936B2

(12) United States Patent
Mizuno et al.

(10) Patent No.: US 7,629,936 B2
(45) Date of Patent: Dec. 8, 2009

(54) BROAD-BAND FERMI ANTENNA DESIGN METHOD, DESIGN PROGRAM, AND RECORDING MEDIUM CONTAINING THE DESIGN PROGRAM

(76) Inventors: Koji Mizuno, 14-6, Kunimi 6-chome, Aoba-ku, Sendai-shi, Miyagi 981-0943 (JP); Kunio Sawaya, 1-31, Hachiman 4-chome, Aoba-ku, Sendai-shi, Miyagi 980-0871 (JP); Hiroyasu Sato, Room 401, 15-1, Tsunogorou 2-chome, Aoba-ku, Sendai-shi, Miyagi 980-0874 (JP); Yoshihiko Wagatsuma, 16-20, Tsurugaoka 4-chome, Izume-ku, Sendai-shi, Miyagi 981-3109 (JP)

( * ) Notice: Subject to any disclaimer, the term of this patent is extended or adjusted under 35 U.S.C. 154(b) by 507 days.

(21) Appl. No.: 11/514,642

(22) Filed: Sep. 1, 2006

(65) Prior Publication Data

US 2007/0152898 A1 Jul. 5, 2007

Related U.S. Application Data

(63) Continuation-in-part of application No. PCT/JP2005/003825, filed on Mar. 1, 2005.

(30) Foreign Application Priority Data

Mar. 2, 2004 (JP) ..... 2004-058031

(51) Int. Cl.
*H01Q 13/10* (2006.01)

(52) U.S. Cl. ..... 343/767; 343/768; 343/770

(58) Field of Classification Search ..... 343/767, 343/768, 770, 873

See application file for complete search history.

(56) References Cited

U.S. PATENT DOCUMENTS 6,008,770 A 12/1999 Sugawara
6,075,493 A * 6/2000 Sugawara et al. ..... 343/767
6,219,001 B1 * 4/2001 Sugawara et al. ..... 343/767

FOREIGN PATENT DOCUMENTS

JP 3462959 8/2003

OTHER PUBLICATIONS

Hiroyasu Sato, "Corrugate Kozo Tsuki Millimeter-Ha Fermi Antenna no Sekkei", The Transactions of the Institute of Electronics, Information and Communication Engineers B, vol. J86-B, No. 9, 2003, pp. 1851 to 1859.

*Primary Examiner*—Shih-Chao Chen
(74) *Attorney, Agent, or Firm*—Frommer Lawrence & Haug LLP; Thomas J. Kowalski; Russell A. Garman

(57) ABSTRACT

There is provided a method for designing a corrugated Fermi antenna having a broad-band and circular directivity required for receiving an image by using a wave of millimeter order. As a first step, an inflection point of the Fermi-Dirac function as a taper function of the Fermi antenna is changed so as to set the beam width of plane H to a beam width having a target directivity. After the beam width of the plane H is set to the target value, the aperture width of the Fermi antenna is changed so as to set the beam width of the plane E to a beam width having a target directivity. Thus, by adjusting the beam width values of the planes H and E independently from each other and matching them with the target values, it is possible to design a Fermi-antenna having a broad-band and circular directivity in a short time.

4 Claims, 23 Drawing Sheets

OTHER PUBLICATIONS

Sato, H., Broadband FDTD analysis of Fermi antenna with narrow width substrate, Antennas and Propagation Society International Symposium, 2003., IEEE vol. 1, Jun. 22-27, 2003, pp. 261-264.

Hiroyasu Sato, "Corrugate Kozo Tsuki Miri-Ha Fermi Antenna no Kotaiiki FDTD Kaiseki", 2003 Nen The Institute of Electronics, Information and Communication Engineers Sogo Taikai B-1-161, 2003.

Henry Nguyen, "Kotaiiki Active Fermi Antenna no Sekkei", 2003 Nen The Institute of Electronics, Information and Communication Engineers Sogo Taikai, B-1-60, 2003.

Naoto Arai, "Miri-Hatai Imaging-yo Fermi Antenna no Tokusei", 2002 Nen The Institute of Electronics, Information and Communication Engineers Sogo Taikai, C-2-94, 2002.

* cited by examiner $$f'(c) = \frac{ab}{4}$$

$$f(x) = \frac{a}{1 + e^{-b(x-c)}}$$

$$\left\{ \begin{array}{l} a = \dfrac{W}{2} \\ b = \dfrac{4}{a} f'(c) \end{array} \right.$$

(A)

(B)

$$\left\{ \begin{array}{l} a = \frac{W}{2} \\ f(x) = \frac{a}{1 + e^{-b(x-c)}} \\ f'(c) = \frac{ab}{4} \end{array} \right.$$

35GHz

H-Plane (A)

E-Plane (B)

(C)

PRIOR ART

PRIOR ART

FIG. 23

| Name of Measures | [mm] | [$\lambda_0$]@35GHz |
|---|---|---|
| Length of Antenna $L$ | 34.28 | 4 |
| Aperture Width $W$ | 7.8 | 0.91 |
| Distance $d$ Between End of Substrate And End of Aperture $d$ | 1.15 | 0.13 |
| Substrate Width $D$ | 10.1 | 1.18 |
| Substrate Thickness $h$ | 0.2 | 0.02 |
| Corrugation Length $lc$ | 1.1 | 0.13 |
| Corrugation Width $w_c$ | 0.3428 | 0.04 |
| Corrugation Pitch $p$ | 0.6856 | 0.08 |
| Slot Line Width $w_s$ | 0.1 | 0.01 |

PRIOR ART

BROAD-BAND FERMI ANTENNA DESIGN METHOD, DESIGN PROGRAM, AND RECORDING MEDIUM CONTAINING THE DESIGN PROGRAM

This application is a continuation-in-part application of international patent application Ser. No. PCT/JP2005/003825 filed Mar. 1, 2005, which published as PCT Publication No. WO 2005/083839 on Sep. 9, 2005, which claims benefit of Japanese patent application Serial No. 2004-058031 filed Mar. 2, 2004.

The foregoing applications, and all documents cited therein or during their prosecution ("appln cited documents") and all documents cited or referenced in the appln cited documents, and all documents cited or referenced herein ("herein cited documents"), and all documents cited or referenced in herein cited documents, together with any manufacturer's instructions, descriptions, product specifications, and product sheets for any products mentioned herein or in any document incorporated by reference herein, are hereby incorpprated herein by reference, and may be employed in the practice of the invention. Citation or identification of any document in this application is not an admission that such document is available as prior art to the present invention. It is noted that in this disclosure and particularly in the claims and/or paragraphs, terms such as "comprises", "comprised", "comprising" and the like can have the meaning attributed to it in U.S. Patent law; e.g., they can mean "includes", "included", "including", and the like; and that terms such as "consisting essentially of" and "consists essentially of" have the meaning ascribed to them in U.S. Patent law, e.g., they allow for elements not explicitly recited, but exclude elements that are found in the prior art or that affect a basic or novel characteristic of the invention. The embodiments of the present invention are disclosed herein or are obvious from and encompassed by, the detailed description. The detailed description, given by way of example, but not intended to limit the invention solely to the specific embodiments described, may best be understood in conjunction, with the accompanying drawings.

TECHNICAL FIELD

The present invention relates to a design method of a wide-band Fermi-antenna which is one of the TSAs (Tapered Slot Antennas), and to the design program and a recording medium for recording the design program.

BACKGROUND ART

A passive imaging in which an image is received in real time by using a millimeter-wave is able to obtain the image of all objects that include building and human body without being influenced by the weather, because of this the commercialization is being expected. The millimeter-wave indicates the electromagnetic wave in which the wave-length is approximately the range from 10 mm to 1 mm, and corresponds to 30 GHz to 300 GHz as the frequencies. In case of comparing it with ones of microwave band, the electromagnetic wave of millimeter-wave band has the characteristics such as: a) a small and light system can be realized; b) the interference and radio interference can be hardly caused because the narrow directivity is obtained; c) information of large capacity can be treated because the frequency band is wide; and d) a high resolution can be obtained when it is used to the sensing, and also has the characteristics such as: e) the attenuation due to fog or rain is very small; and f) the transmissivity to dust or small dust is good and it is strong for environmental conditions, In case of comparing it with ones of visibility or infrared range.

In an imaging system which uses the millimeter-wave, there are two methods of an active imaging and passive imaging if it is roughly classified. The active imaging is the one that irradiates to the object the coherent millimeter-wave radiated from an oscillator and receives and detects the reflective wave or transmissive wave and obtains the image corresponding to the received strength or phase. This method is used for a radar and plasma electron density measurements etc.

Also, the passive imaging is the method which receives widely the millimeter-wave portion in the thermal noise that every object is radiating in proportion to the absolute temperature and detects and amplifies this and obtains the image. Although there are advantages such as: it does not require the oscillator; and also there is no influence of the interference in order to receive the coherent wave and the signal processing is easy, a receiver with the low noise and high sensitivity is required because the receiving-signal is the very feeble one that is the thermal noise. This method is used for a radiometer that measures the ozone and carbon monoxide etc. in the atmosphere, and for the field of radio astronomy etc.

This real-time passive imaging which uses the millimeter-wave is performed by receiving the thermal noise generated from the objects 100 such as a human and thing etc., by a receiving element for imaging 102 that was arranged at a focal position of a lens antenna 101 through the lens antenna that has a circular directivity, as shown in FIG. 21. Because of this, the development of the receiving element (antenna) for imaging that matches the lens antenna 101 has become extremely important. Usually, a diameter (D) of the lens antenna 101 is designed to be equal to the focal distance (f), and it is assumed that the passive imaging of best condition is performed when an f/D is equal to 1 (here, f/D means: f is divided by D).

Although there is a method in which a mechanical scanning is used in the real-time imaging method, a complex mechanism for scanning is required in this method and also it takes a lot of time for measurement, therefore it is difficult to obtain the real-time image. On the other hand, an imaging array method in which many receiving elements are arranged in two-dimensions and the image is obtained does not require the scanning mechanism and is able to measure it in short time, thereby being able to perform the real-time imaging. In FIG. 21, though one receiving element for imaging 102 is illustrated, a plurality of receiving elements for imaging is being arranged side by side in the array shape, actually.

Further, as antenna which is suitable for this receiving element for imaging 102, because the lens antenna 101 has the circular directivity it is required that the directivity of E-plane and the directivity of H-plane are almost equal in order to match this lens antenna 101. Here, the E-plane (x-z plane) is a resonant plane of the electric field and the H-plane (x-y plane) is a plane perpendicular to the E-plane. Generally, even if it strongly resonates for the E-plane and can receive the image from the object, there are many cases in which there is no directivity of the H-plane, so there are problems such as: the conversion efficiency decreases and a gain becomes low too.

Also, as for the characteristics which are required further, other than the one which is a broadband and which is suitable for integration and array, it is desired that as many antennas as possible in a specified area etc. can be arranged because the number of array elements determines the pixels of imaging. Furthermore, it needs to amplify a received signal until the noise level of a detector, so it is required that the antenna has a high gain in the meaning of decreasing a loss to an amplifier.

As a dominant antenna that satisfies these requirements, the research of a TSA (Tapered Slot Antenna) is being carried out prosperously, recently. This TSA is a broadband, light-weight and thin-shape, and is able to be made easily by the photolithographic technology and is integrated easily, so it is being used for various kinds of usage such as the communication-use and measurement-use from the frequency band of the microwave to the millimeter-wave. A fundamental principle of operation of this TSA is explained as a traveling-wave antenna. In other words, it is different from a reflective-type antenna such as a dipole antenna, and it is being understood as the antenna by which a generated electromagnetic wave is propagated to the traveling-direction without vibrating as it is. Then, as taper shapes of the TSA, a Linear-TSA and a Vivaldi-TSA (that is a taper shape with an exponential function of trumpet-type) are used well.

Also, a CWSA (Constant Width Slot Antenna) in which several different function forms were connected and a BLTSA (Broken Linearly TSA) which has the taper shape in which the LTSA was bent and connected are proposed.

Furthers a tapered slot antenna TSA called a Fermi-antenna is also being proposed recently, and a structure of this Fermi-antenna 10 has a taper shape that is represented by a Fermi-Dirac function (called "Fermi function", hereinafter), as shown in FIG. 22, and also has a corrugation structure 12 of comb shape in the outside of a dielectric substrate 11. This Fermi-antenna 10 is being considered to be suitable for the receiving antenna for millimeter-wave imaging, because the facts in which the directivities of the E-plane and H-plane are almost equal even though the width of the substrate is narrow and also the levels of side-lobes are comparatively small are being found out experimentally.

FIG. 22 is the one showing a fundamental structure of the Fermi-antenna 10, and the characteristics of this antenna are to have the taper shape which is represented by the Fermi-Dirac function and the corrugation structure 12 in the outside of the dielectric substrate 11. This Fermi-antenna is advantageous in the following points; it can be easily made on the dielectric substrate 11 by using the photolithographic technology and, the antenna and feeding circuits can be configured on one side of the dielectric substrate 11. The Fermi-function is the one that is known as the function that represents the energy-level of electron in the quantum mechanics, and it generally becomes a function that is given by the "equation 1", when the structure and coordinate system of FIG. 22 are considered.

$$f(x) = \frac{a}{1 + e^{-b(x-c)}} \qquad \text{\{Equation 1\}}$$

Here, a, b and c are the parameters that represent the taper shape. The "a" represents an asymptotical value of the function when X approaches the infinity, and the "c" is a point of infection of the function. Also, from f' (c)=ab/4, the "b" is a parameter that determines tangential gradient at the point of infection. Here, if there are the relations of the f(c)=a/2 and also b(L−c)>>1, the X=L is assumable at near of an aperture, and it becomes f(L)=a, consequently the width of the aperture W is given by W=2a. In addition, as the design parameters of Fermi-antenna, a relative dielectric constant $\in_r$ of the dielectric substrate, the thickness of the substrate h, the length of antenna L, the width of corrugation structure $W_c$, the pitch p, the height of corrugation $L_c$ and the Fermi-functional parameters a, b and c that determine the taper shape are extremely many, therefore how these values are chosen if the antenna that is small and that has the circular directivity of desired beam width $BW_{design}$ can be designed has become an important subject.

With respect to this Fermi-antenna, the paper which showed that the side-lobes of H-plane of the Fermi function tapered TSA are reduced most in comparison with the LTSA, Vivaldi, CWA and BLTSA and the TSA which uses the taper with Fermi function at 60 GHz frequency is proposed (for example, referrer to the published document 1). In this published document, it is shown that though the directivities of E-plane and H-plane will differ when the width of substrate of the Fermi-antenna becomes narrow, the directivities can be made almost equal by providing this the corrugation structure.

Also, the inventors obtained a radiation directivity by a FDTD (Finite Difference Time Domain) method when the taper shape of Fermi-antenna (namely, Fermi functional parameters; a, b, c), the length of antenna L, the thickness of dielectric h, the aperture width W and the width of substrate D were changed, and did clarify the relationship between the various parameters relating to the structure of antenna and the characteristics of antenna, and proposed an optimal structure of the Fermi-antenna that was suitable for the receiving element for imaging (referrer to the published document 2). FIG. 23 is the one showing an example of the measures of typical Fermi-antenna that were proposed here. According to this published document 2, an operating gain was 13.2 dBi (here, "i" means "isotropic") and the levels of side-lobes of E-plane and H-plane were −18.4 dBi and −14.3 dBi respectively, and also it had a good axis symmetry and it was reported that the result which accorded well with an experiment was obtained, in the Fermi-antenna with the width of substrate $D=0.58\lambda_0$ and aperture width $W=0.32\lambda_0$. In this example, the measures of typical Fermi-antenna that were designed at 35 GHz are shown, and these are $c=2\lambda_0=17.14$ mm, a=W/2=3.9 mm and $b=0.28\ mm^{-1}$, here.

However, the TSA that includes a Fermi-antenna has many structural parameters such as a function that determines the taper shape, the length of antenna, the aperture width, the finite width of substrate and a relative dielectric constant, and has a characteristic that the radiation characteristic changes largely in accordance with the changes of these. Because of this, there were no method other than an empirical method according to the experiment and a method according to the approximate computation when the Fermi-antenna was designed. In other words, in the present, even if the TSA was made and the one having a good characteristic was yielded by chance, the characteristic has changed whenever it was made, and therefore it was the situation in which a firm design theory was not being established. Like this, there is such reality that is not easy to obtain the design guideline that realizes the radiation directivity required to the Fermi-antenna, and the design method of the TSA having a circular directivity was not presented even in the proposal described in the above-mentioned published document 1 and published document 2.

[Non-patent Document 1] S. Sugawara etc. "An m-m wave tapered slot antenna with improved radiation pattern", IEEE MTT-S International Microwave Symposium Digest, pp. 959-962, Denver, USA, 1997

[Non-patent Document 2] The Institute of Electronics, Information and communication Engineers transactions B. Vol. J80-B, No. 9 (2003.9)

DISCLOSURE OF THE INVENTION

In view of the above, the present invention is to provide a design method to obtain an optional beam width of the radiation pattern having a circular directivity which uses a Fermi-antenna, and to provide a program for that.

According to an embodiment of the present invention, the present invention is a design method of a Fermi-antenna with corrugation that has a broadband and circular directivity which are necessary for the reception imaging of millimeter-wave, and it includes the steps of: an H-plane beam width is set to a beam width having a directivity of target by changing a point of infection of a Fermi-Dirac function that is a taper function of the Fermi-antenna; and an E-plane beam width is set to the beam width having the directivity of target by changing an aperture width of this Fermi-antenna, and by those, the wideband and circular directivity are realized.

Further, the present invention is a design method which includes the steps of: a step which gives a center frequency of broadband frequencies or a corresponding wave-length; a step which determines an effective thickness of a dielectric substrate of the Fermi-antenna; a step which determines a length of antenna of the Fermi-antenna; a step which determines a width, pitch and height of corrugation of the Fermi-antenna; a step which determines parameters of Fermi-Dirac function that form a taper shape of the Fermi-antenna; a step which sets up target values of beam widths of an H-plane and E-plane of an electromagnetic-wave that is radiated from the Fermi-antenna; an H-plane beam width comparative step which compares the H-plane beam width with the preset target value of H-plane beam width after a point of infection of the Fermi-antenna was set optionally; an H-plane beam width decision cycle which repeats again the step that compares the H-plane beam width with the preset target value of H-plane beam width after having changed a position of the point of infection when it does not accord with the target value in this H-plane beam width comparative step; as next step, a step which sets up an aperture width of the Fermi-antenna when the H-plane beam width has accorded with a preset H-plane beam width in the H-plane beam width comparative step; an E-plane beam width comparative step which compares the E-plane beam width of an electromagnetic-wave that is radiated on the basis of this set aperture width with the preset target value of E-plane beam width; and an E-plane beam width decision cycle which repeats again the step that compares said E-plane beam width with the preset target value of E-plane beam width by changing the aperture width when it does not accord with said target value in this E-plane beam width comparative step, and by which it is designed so that both of the H-plane beam width and the E-plane beam width have almost equal circular directivities.

Furthermore, the present invention also includes a design program to realize the above-mentioned design method and a recording medium that recorded the program. In other words, it is a program for designing a Fermi-antenna with corrugation that has a broadband and circular directivity which are necessary for the reception imaging of millimeter-wave, and it includes: the program for designing broadband Fermi-antenna which includes and/or executes the procedures of: a procedure which gives a center frequency of broadband frequencies or a corresponding wave-length; a procedure which determines an effective thickness of a dielectric substrate of the Fermi-antenna; a procedure which determines a length of antenna of the Fermi-antenna; a procedure which determines a width, pitch and height of corrugation of the Fermi-antenna; a procedure which determines parameters of Fermi-Dirac function that form a taper shape of the Fermi-antenna; a procedure which sets up target values of beam widths of an H-plane and E-plane of an electromagnetic-wave that is radiated from the Fermi-antenna; a procedure which compares said H-plane beam width with the preset target value of H-plane beam width after a point of infection of the Fermi-antenna was set optionally; a procedure which repeats the procedure that compares the H-plane beam width with the target value of H-plane beam width after having changed a position of the point of infection of the taper shaped Fermi-Dirac function when this H-plane beam width does not accord with the target value of H-plane beam width, and which sets up an aperture width of the Fermi-antenna when the H-plane beam width has accorded with the preset H-plane beam width in the procedure that compares the H-plane beam width; a procedure which compares the E-plane beam width of an electromagnetic-wave that is radiated on the basis of said set aperture width with said preset target value of E-plane beam width; and a procedure for designing it so that both of the H-plane beam width and the E-plane beam width have almost equal circular directivities, by repeating the procedure which compares the E-plane beam width with the preset target value of E-plane beam width by changing the aperture width when the E-plane beam width does not accord with the target value of E-plane beam width in the procedure that compares this E-plane beam width; and a recording medium that recorded this program.

According to the design method and design program of the broadband Fermi-antenna of the present invention, the radiation patterns of E-plane and H-plane can accord with the target value in the comparatively short time and the desired beam width can be given to both of E-plane and H-plane and also the side-lobes can be set to the low level, thereby being able to realize the Fermi-antenna suitable for the receiving element for millimeter-wave imaging.

BRIEF DESCRIPTION OF DRAWINGS

FIG. 3(A) is a case without a dielectric and FIG. 3(B) is a case with a dielectric;

FIGS. 7(A), 7(B), 7(C) and 7(D) show corrugation structures respectively when the pitch is p=2wc, 4wc, 8wc and 10wc, and FIG. 7E is a graph showing frequency-gain characteristic of each corrugation structure of the Fermi-antenna;

FIG. 23 is a diagram showing measures of a typical Fermi-antenna.

BEST MODE FOR CARRYING OUT THE INVENTION

Hereinafter, embodiments of the design method of the Fermi-antenna that is a representative one of the broadband antenna according to the present invention are explained. As mentioned above, as the design parameters of Fermi-antenna, a relative dielectric constant $\in_r$ of the dielectric substrate, the thickness of the substrate h, the length of antenna L, the width of corrugation structure $W_c$, the pitch p, the height of corrugation $L_c$ and the Fermi-functional parameters (a, b and c) that determine the taper shape are actually many, and about how these values are chosen if the antenna that is small and that has the circular directivity of desired beam width $BW_{design}$ can be designed and also an example of the design to the 35 GHz frequencies are explained by using a design flow chart shown in FIG. 1.

The reasons that set the frequency to 35 GHz are: there is a frequency band in which an attenuation of radio-wave by the atmosphere is small in the vicinity of 35 GHz, so-called window of the atmosphere; and because the wave-length corresponding to 35 GHz is 8.57 mm and the half wave-length is 4.28 mm, it can be designed until the very limit of the resolution of Rayleigh 5.0 mm that is a limit by which the images of two point-objects are separated.

Here, about the resolution of Rayleigh is explained. Generally, because a point-image according to an optical system has a distribution with spread in the center of a near axis point-image by a diffraction phenomenon of light, the images of the two objects that adjoined are overlapping partially. If this overlap increases a minimum distance where the images of two point-objects are not recognized by that is conceivable. Such minimum distance between two point-objects is called "resolution", and the resolution of Rayleigh is applied to a limit by which these two point-objects are separated.

Hereinafter, An example of embodiment of the present invention is explained based on FIGS. 1 to 18. First, a fundamental operating characteristic of the Fermi-antenna is examined by using the FDTD method that is a high accurate electromagnetic analysis, and then an example of the design of the Fermi-antenna that uses the receiving element for imaging is explained.

The FDTD method is a method in which a Maxwell equation that is given by the partial differentiations of the electric field and magnetic field by the variables of time and space is replaced by the differences of time and space and then this is solved numerically. Although this FDTD has an advantage that the general-purpose usability is high, it has also a disadvantage that requires the large-scale memory and long numeric computation in order to divide the space into the cell of rectangular parallelepiped.

Figure 1:
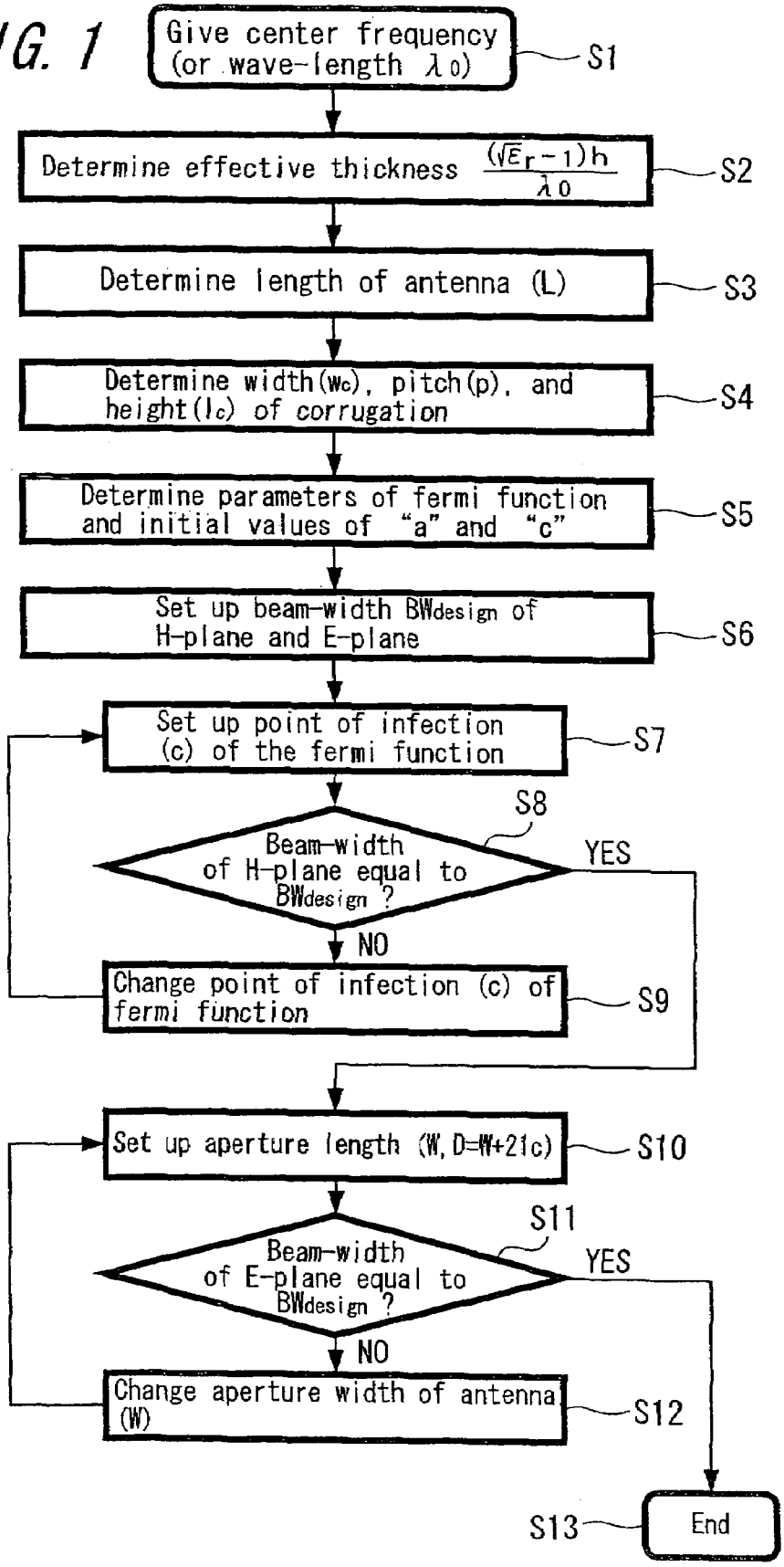
FIG. 1 is a flow chart showing a design method and program of a Fermi-antenna of the first embodiment according to the present invention.

FIG. 1 is a flow chart showing an embodiment of design method of the broadband antenna of the present invention, and an example of design method of the Fermi-antenna that has the circular directivity according to this flow chart is explained. FIGS. 2 to 19 are diagrams for explaining data that become the bases that determine each parameter.

First, a design center frequency of the Fermi function or a center wave-length $\lambda_0$ is given (step S1). The Fermi-antenna has generally the broadband nature of several octaves, and the center frequency means the center frequency of the broadband. When it is called the broadband, it means that the comparatively wide band around the center frequency is possible to be used. For example, when a 35 GHz is selected to the center frequency, it means that the design is done so that it is possible to use from about 30 GHz to about 45 GHz.

Figure 2:
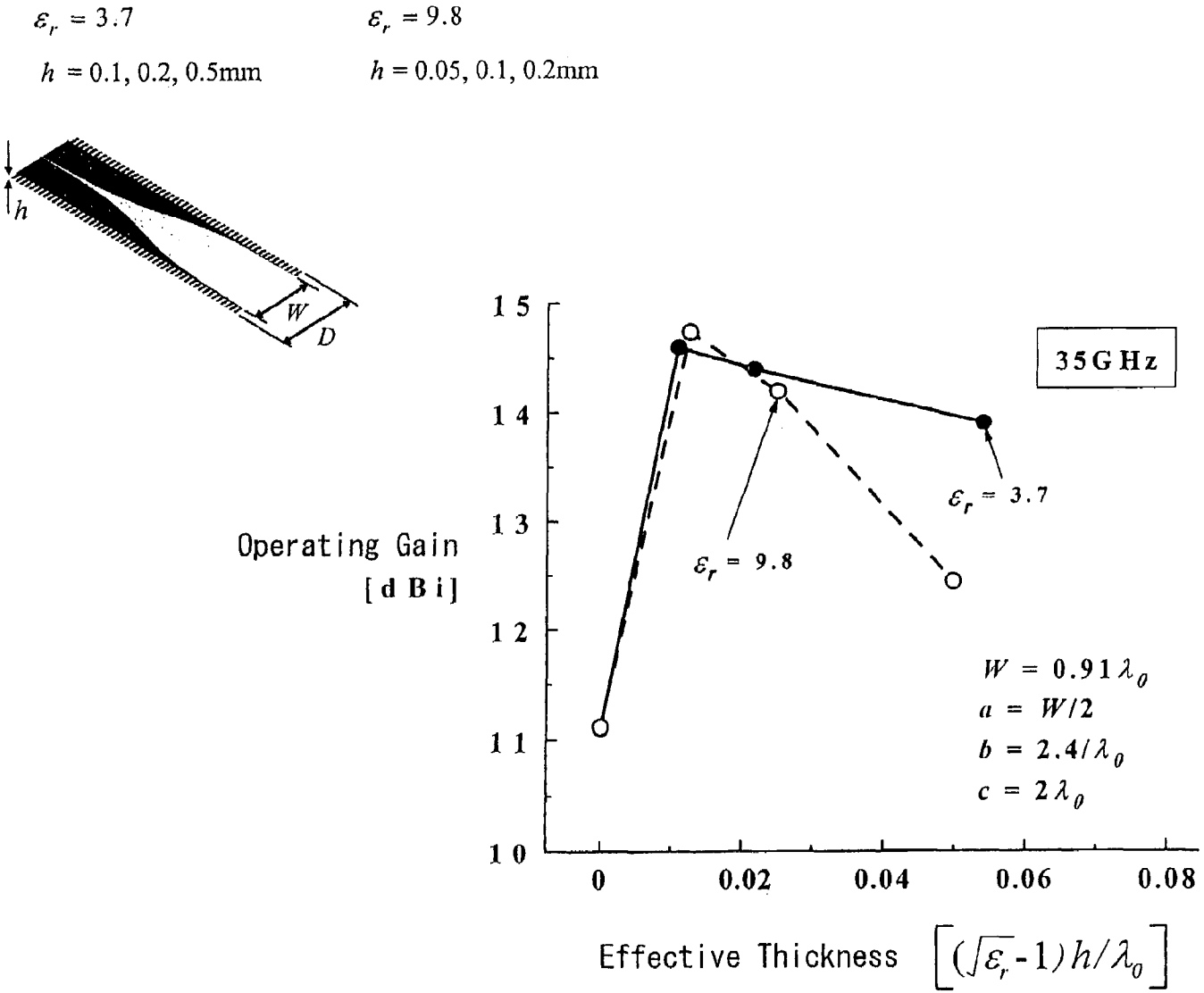
FIG. 2 is a graph showing a relationship with an effective thickness and gain which are used in the Fermi-antenna of the present invention.
Figure 3:
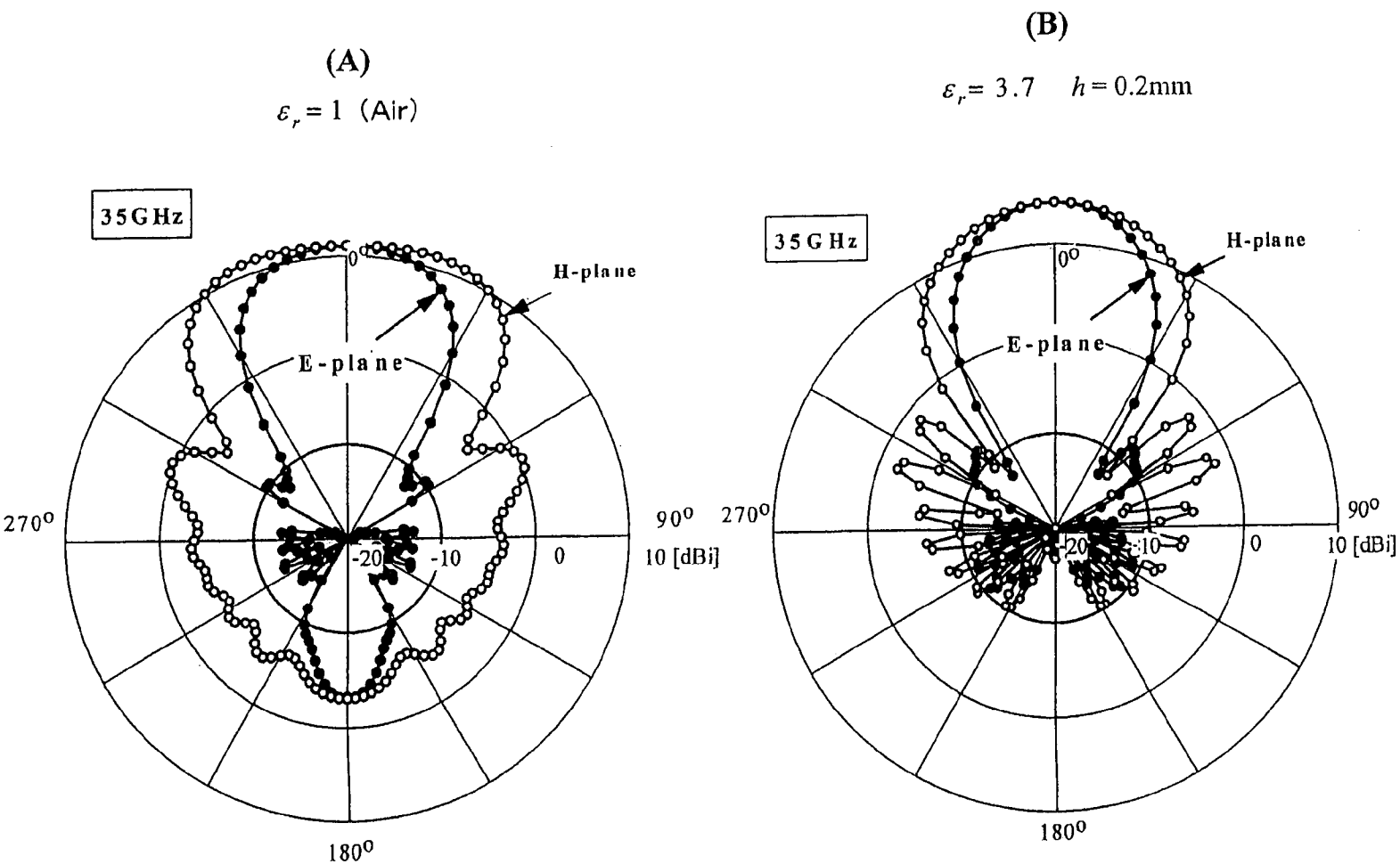
FIGS. 3(A) and 3(B) are diagrams showing operating patterns of H-plane and E-plane of the Fermi-antenna with or without a dielectric.

Subsequently, the effective thickness of the dielectric substrate is determined (step S2). This effective thickness, as shown in "an equation 2", is a value in which: a value where a value that reduces one from a square root of the relative dielectric constant of the dielectric substrate $\in_r$ is multiplied by the thickness of the dielectric substrate h is further divided by the wave-length $\lambda_0$ of the center frequency. In the step S2, it is set up so that this value satisfies "an equation 2". FIG. 2 is a graph showing the operating gain of the time when the effective thickness was changed by changing the combination of the thickness of the dielectric substrate h of three kinds (0.1 mm, 0.2 mm and 0.5 mm) and the relative dielectric constant $\in_r$ of two kinds (3.7 and 9.8). As it is apparent from this graph, in either case of $\in_r$=3.7 and $\in_r$=9.8, it becomes a maximum gain at where the effective thickness is around 0.01. This is caused by that: in the vicinity where the effective thickness is 0.01, both of the structure of corrugation and the dielectric of the inside of taper do work as a slow-wave structure, and become the thickness in which the electromagnetic waves along these become the same phase, thereby expanding the effective aperture area. In other words, a surrounding portion also becomes the slow-wave structure by making it the corrugation structure though the vicinity of a slot axis of the Fermi-antenna is the slow-wave structure from the beginning, and consequently the electromagnetic waves become the same phase over the whole of aperture width and are transmitted.

Also, FIG. 2 is showing that though the gain decreases slightly when the effective thickness is increased, the decrease is not so big, and even if the effective thickness is comparatively thick the deterioration of operating gain is small. Therefore, if the effective thickness is satisfying the equation 2, the operating gain that may be satisfied as the design can be obtained. Further, as it is understandable from FIGS. 3(A) and 3(B), it can be understood that when the case that provides the dielectric (FIG. 3(B)) and the case that does not provide the dielectric (FIG. 3(A)) are compared, the electric power is concentrated in the forward direction over the whole directions of the E-plane and H-plane, in the one which provides the dielectric. In addition, in the analysis of the operating gain in the effective thickness of FIG. 2, the aperture width of antenna is W=0.91$\lambda_0$, and the parameters of Fermi function are a=W/2, b=2.4/$\lambda_0$ and c=2$\lambda_0$.

$$0.01 \leqq \frac{(\sqrt{\varepsilon_r}-1)h}{\lambda_0} < 0.05 \qquad \text{\{equation 2\}}$$

Figure 4:
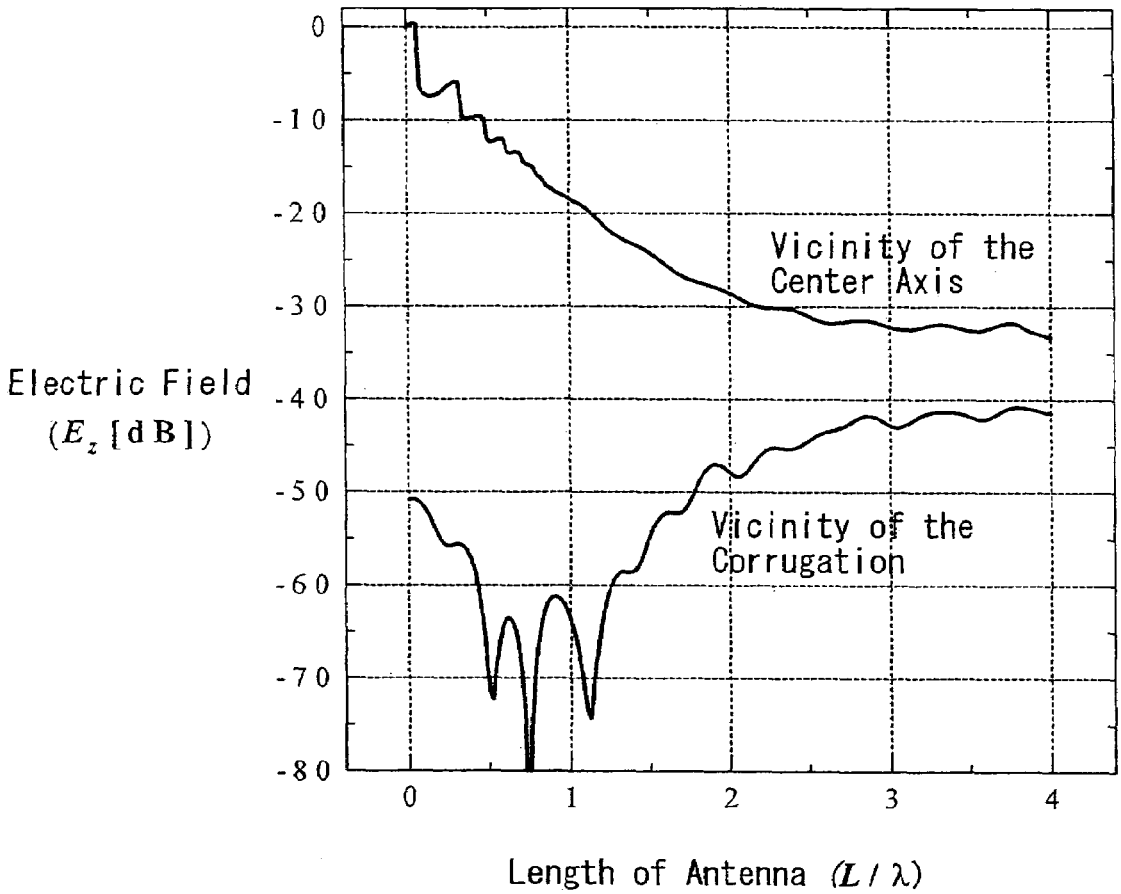
FIG. 4 is a graph showing field strength on the inside or the outside of taper of the Fermi-antenna.

Next, in the flow chart of FIG. 1, the length of antenna (L) is determined (step S3). FIG. 4 is showing the one in which the distribution of electric field strength in the vicinity of a slot line axis of the taper of antenna and the distribution of electric field strength in the vicinity of corrugation of the outskirts were analyzed, in order to determine the length of antenna L. Like this, the length of antenna L can be determined by obtaining the length by which the wave driven by the slot line is attenuated sufficiently at the forefront portion of antenna by the electromagnetic analysis according to the FDTD method. In other words, according to FIG. 4, the electric field of the vicinity of the center axis (slot axis) of taper attenuates in accordance with being away from a feed point (L/$\lambda$=0), and is saturated at near of L=4$\lambda$. On the other hand, the electric field analyzed in the vicinity of the corrugation increases in accordance with being away from the feed point (L/$\lambda$=0), and also is saturated at near of L=4$\lambda$.

This means that both of the electric field on the center axis and the electric field of vicinity of corrugation are stabilized if the L comes to near of 4, and from this result, because it is effective to be given the length of about 4$\lambda$ as the length of antenna, here, L=4$\lambda$ is decided. Of course, it may not be necessary to be L=4$\lambda_0$, and it may be L=3$\lambda_0$ from FIG. 4.

Next, in the flow chart of FIG. 1, the measures of the corrugation structure, namely an effective height of corrugation $L_c$, pitch of corrugation p, width of corrugation $W_c$, are determined (step S4).

This corrugation structure is a slow-wave line that usually uses for a horn-antenna etc, and it was used for changing the beam width in the Fermi-antenna of the related art. The measure of the corrugation structure of this invention is different from ones of the related art, in the point that if it is decided once, it is not changed.

First, the width of corrugation $W_c$ is determined. It is known that this width of corrugation is sufficient to be sufficiently narrow for the wave-length, and because it is suitable to set a value to which the length of antenna is divided by 100, Wc=L/100=$\lambda_0$/25 about, it is set as Wc=L/100=$\lambda_0$/25 in the following analysis.

Figure 5:
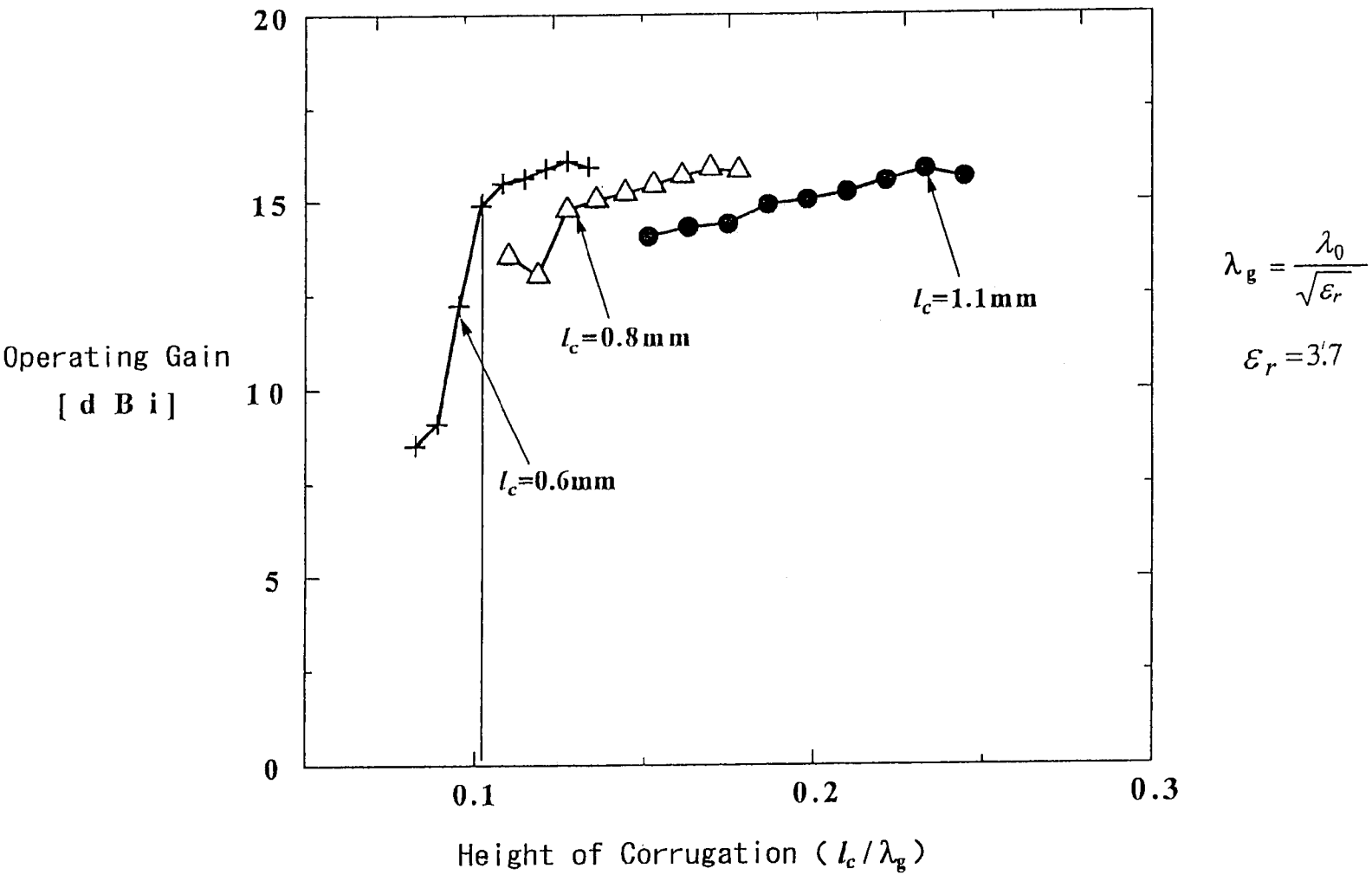
FIG. 5 is a graph showing operating gains versus effective heights (or lengths) of corrugation when a glass is used as a dielectric substrate of the Fermi-antenna.
Figure 6:
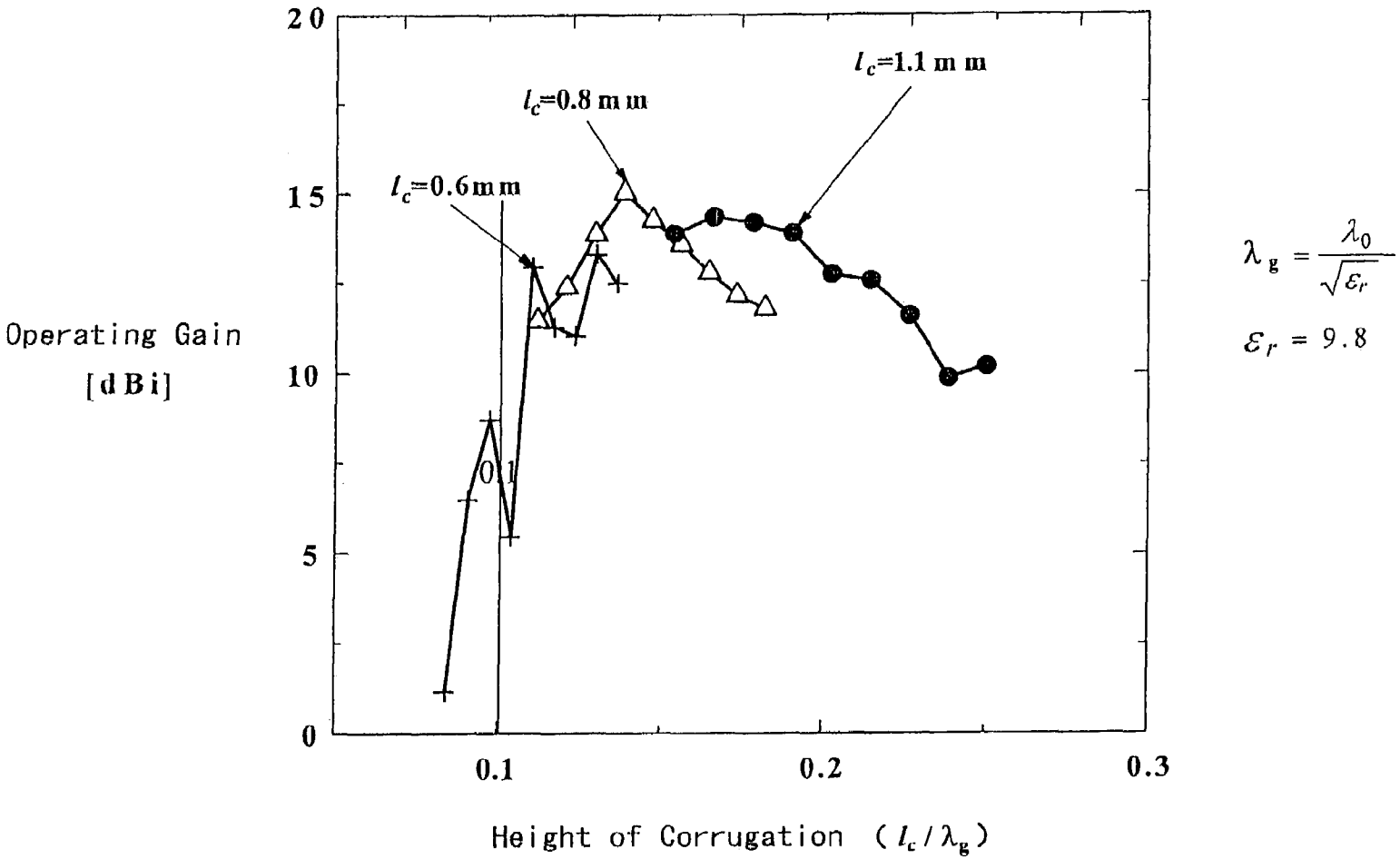
FIG. 6 is a graph showing the operating gains versus effective heights (or lengths) of corrugation when an alumina is used as a dielectric substrate of the Fermi-antenna.
Figure 7:
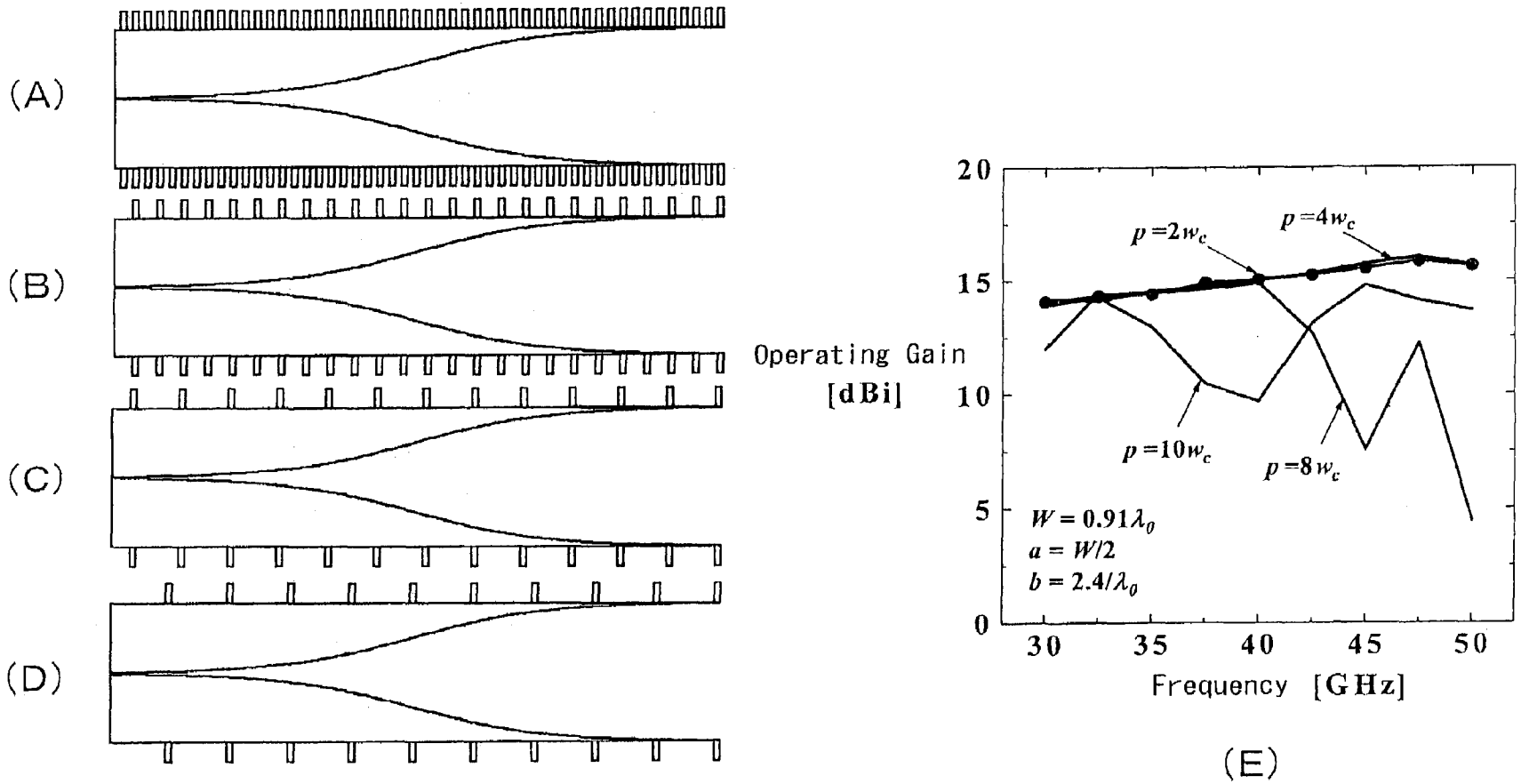
FIGS. 7(A) to 7E are diagrams showing frequency-gain characteristic in accordance with the relationship with the width and pitch of the corrugation of the Fermi-antenna.

Similarly, in the step S4, the height of corrugation $L_c$ is determined. In order to determine the effective height of corrugation, as shown in FIGS. 5 and 6, analysis of the operating gain characteristics versus the effective height of corrugation $L_c$ was performed. FIG. 5 is the case of a glass substrate (relative dielectric constant is 3.7) and FIG. 6 is the case of alumina substrate (relative dielectric constant is 9.8) and these are the ones showing the results that the operating gains were analyzed by the FDTD by changing the height of corrugation. Here, $\lambda_g$ is an actual wave-length, and is a value in which the center wave-length $\lambda_0$ at the vacuum state is divided by the square root of the relative dielectric constant. As shown in the results of analysis of FIGS. 5 and 6, it was recognized that the operation gain had almost the flat characteristic when the effective height of corrugation $L_c/\lambda_g$ is more than 0.1 about. In other words, it was analyzed that the high gain characteristic is obtained when the effective height of corrugation $L_c/\lambda_g$ for the center frequency or use-minimum frequency is more than 0.1.

Next, in the step S4 in the flow chart of the same FIG. 1, the pitch of corrugation p is determined. FIGS. 7(A) to 7(D) are the ones that schematically showed the relationship with the width of corrugation $W_c$ and the pitch p, and that are; P=2$W_c$, p=4$W_c$, p=8$W_c$ and p=10$W_c$, respectively. Also, FIG. 7E is a diagram showing the operating gain characteristic when the frequency is changed, and it was recognized that the operating gain with a high gain and stability over the broadband from about 30 GHz to 50 Ghz is obtained, in case of p=2$w_c$ and p=4$W_c$. because of this, it is understood that it is sufficient to decide the pitch of corrugation as p=2$W_c$.

Next, in the flow chart shown in FIG. 1, a, b and c which are parameters of the Fermi function are determined (step S5). This parameter is the one that determines the taper shape of the Fermi function.

In this step S5, an initial value of the parameter "a" is set up, first. The parameter "a" is a parameter that relates to the aperture width W (W=2a), and as the initial value, the aperture width is set as about one wave-length (W=$\lambda_0$), namely it is set as a=$\lambda_0$/2 (reference to FIG. 8). Similarly, in the step S5, an initial value of the parameter "c" is set up. This parameter "c" is a parameter showing a position of a point of infection of the taper shape of the Fermi function in the axis direction of the Fermi-antenna, and the beam width of H-plane is mainly determined by this parameter "c". As an initial value, like the above, it is set as a half of the length of antenna L, namely, $c=L/2$ ($=2\lambda_0$).

Figure 8:
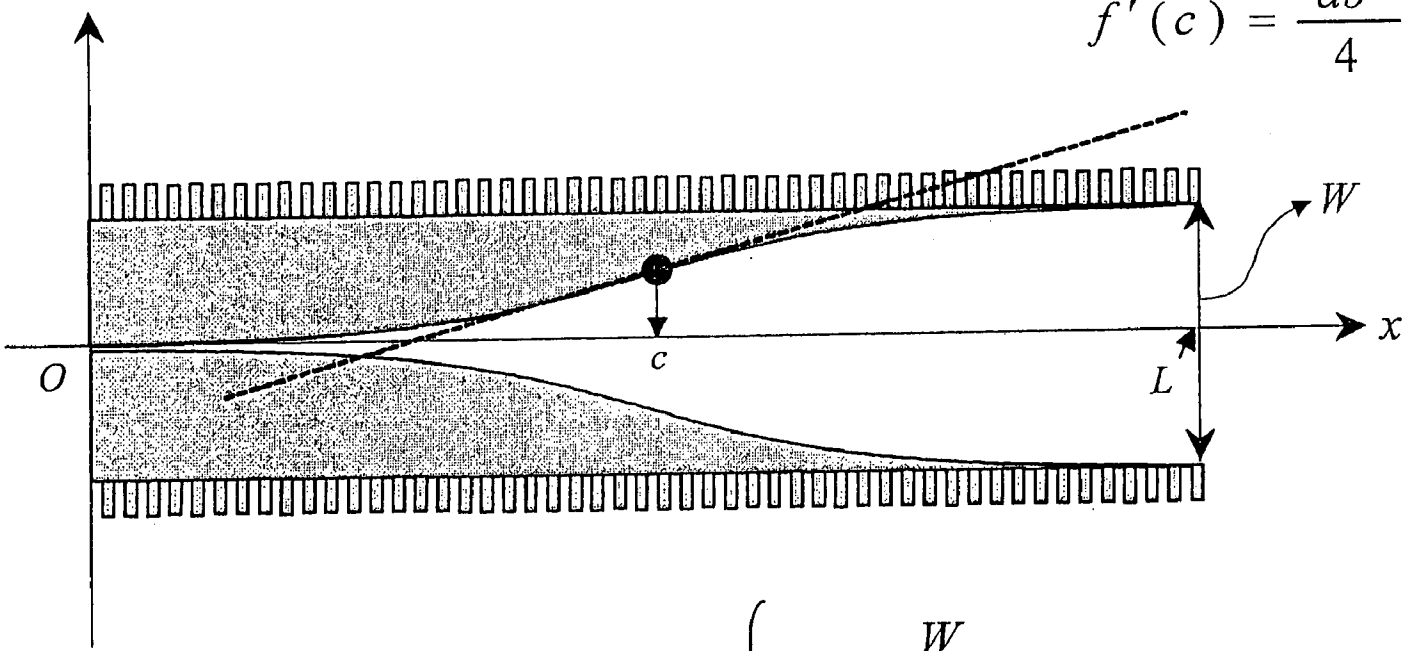
FIG. 8 is a diagram showing tangential gradient at a point of infection in a case when a point of infection of taper shape of the Fermi-antenna is at the center of the length of antenna.
Figure 9:
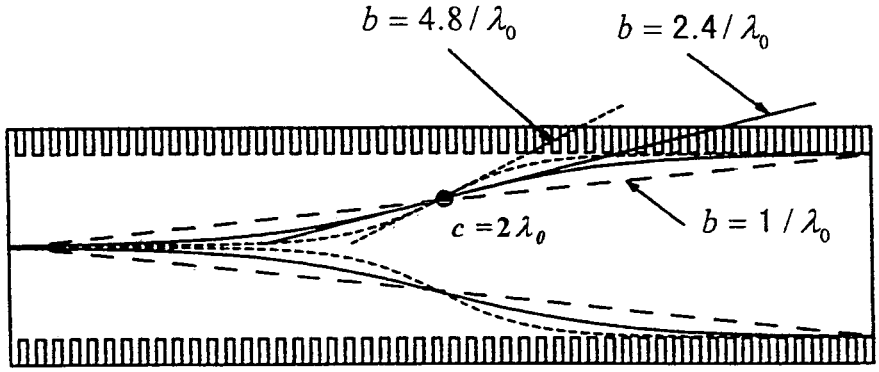
FIGS. 9(A) and 9(B) are diagrams showing a taper shape (FIG. 9(A)) and frequency characteristic of the level of the side-lobes of H-plane (FIG. 9(B)) when a parameter b of the Fermi-antenna is changed.
Figure 9:
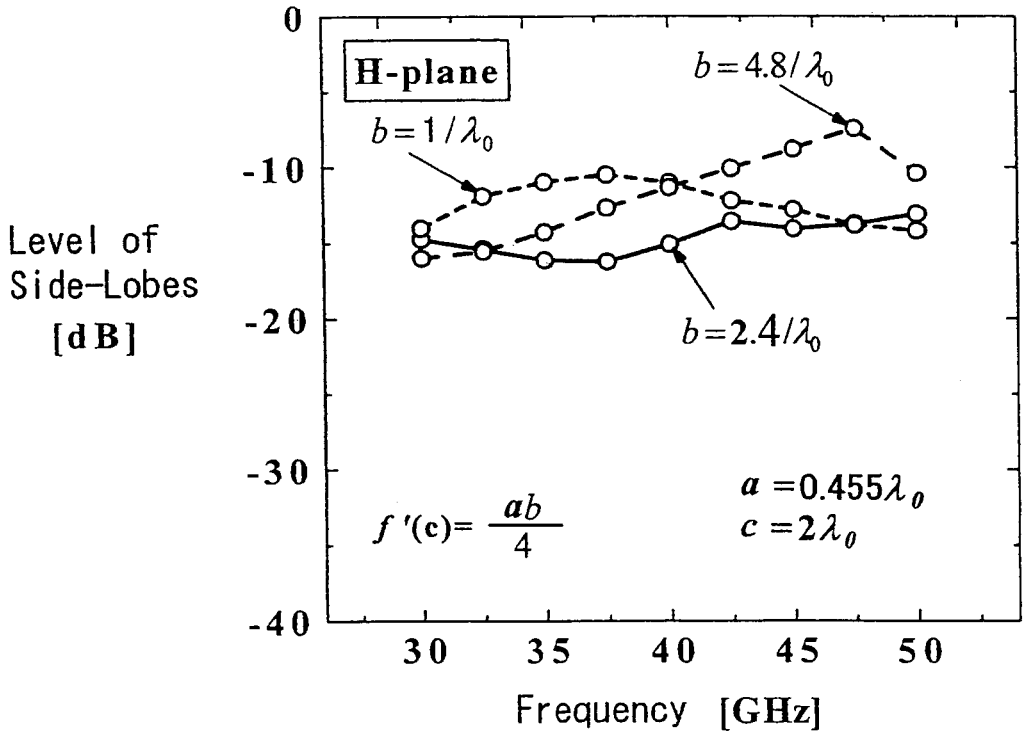

Subsequently, in the step S5, the parameter "b" is determined. The parameter "b" is a value that determines tangential gradient at the point of infection, and if the gradient f' (c) is determined the "b" is obtained from the relation of $b=4f'(c)/a$. For example, as shown in FIG. 8, the taper shape becomes almost straight line (LTSA) when the point of infection is placed in the center of antenna ($c=L/2=2\lambda_0$) and the gradient is selected as $f'(c)=W/2L$ ($b=1/\lambda_0$). Then, in order to further reduce the levels of the side-lobes, the frequency change of the side-lobes was analyzed by selecting the parameter "b" as $2.4/\lambda_0$. In addition, in here, the "a" was set as $a=0.455\lambda_0$. As it is apparent from FIG. 9(B), it is understood that the level of the side-lobes of H-plane is low over the broad frequency range when the ($b=2.4/\lambda_0$) is selected from the $b=1/\lambda_0$, $b=2.4/\lambda_0$, and $b=4.8/\lambda_0$. It is conceivable that it (antenna) becomes substantially high gain if the level of the side-lobes is low, and that these side-lobes are low in the broadband range becomes important to the design of the Fermi-antenna. Therefore, in here, the parameter "b" is determined as $b=2.4/\lambda_0$.

Next, in the flow chart of FIG. 1, a target value $BW_{design}$ of the beam widths of H-plane and E-plane that should design are set up (step S6). In here, the design center frequency is 35 GHz, and the target value is determined to a structure in which the radiation directivity becomes the target value ($BW_{design}$=52 degrees) of 10 dB-beam width.

Here, the cell sizes in the FDTD method are; $\Delta x=0.1714$ mm, $\Delta y=0.1$ mm and $\Delta z=0.05$ mm in a case when a glass material is used as the dielectric (the case of $\in_r=3.7$), and are; $\Delta x=0.1714$ mm, $\Delta y=0.05$ mm and $\Delta z=0.05$ mm in a case when alumina is used as the dielectric (the case of $\in_r=9.8$). The one which is changed by the difference of the dielectric is only the cell size in the y-direction.

Next, in the flow chart of FIG. 1, a value of the point of infection "c" of the Fermi-antenna is tentatively set up (step S7). In here, it is set as a half value ($c=L/2$) of the length of antenna that was set up in the step S5, and go to the next decision step S8. In the decision step S8, it is judged whether or not the beam width of H-plane is equal to the target value of beam width ($BW_{design}$=52 degrees) that was set up in the step S6. If the beam width of H-plane is equal to the target value (52 degrees) it goes to the next step in which the beam width of E-plane is determined, and if it was judged that the beam width of H-plane is not equal to the target value (52 degrees), the step S7 and the step S8 are repeated after having changed the point of infection "c" of the Fermi function (step S9).

Figure 10:
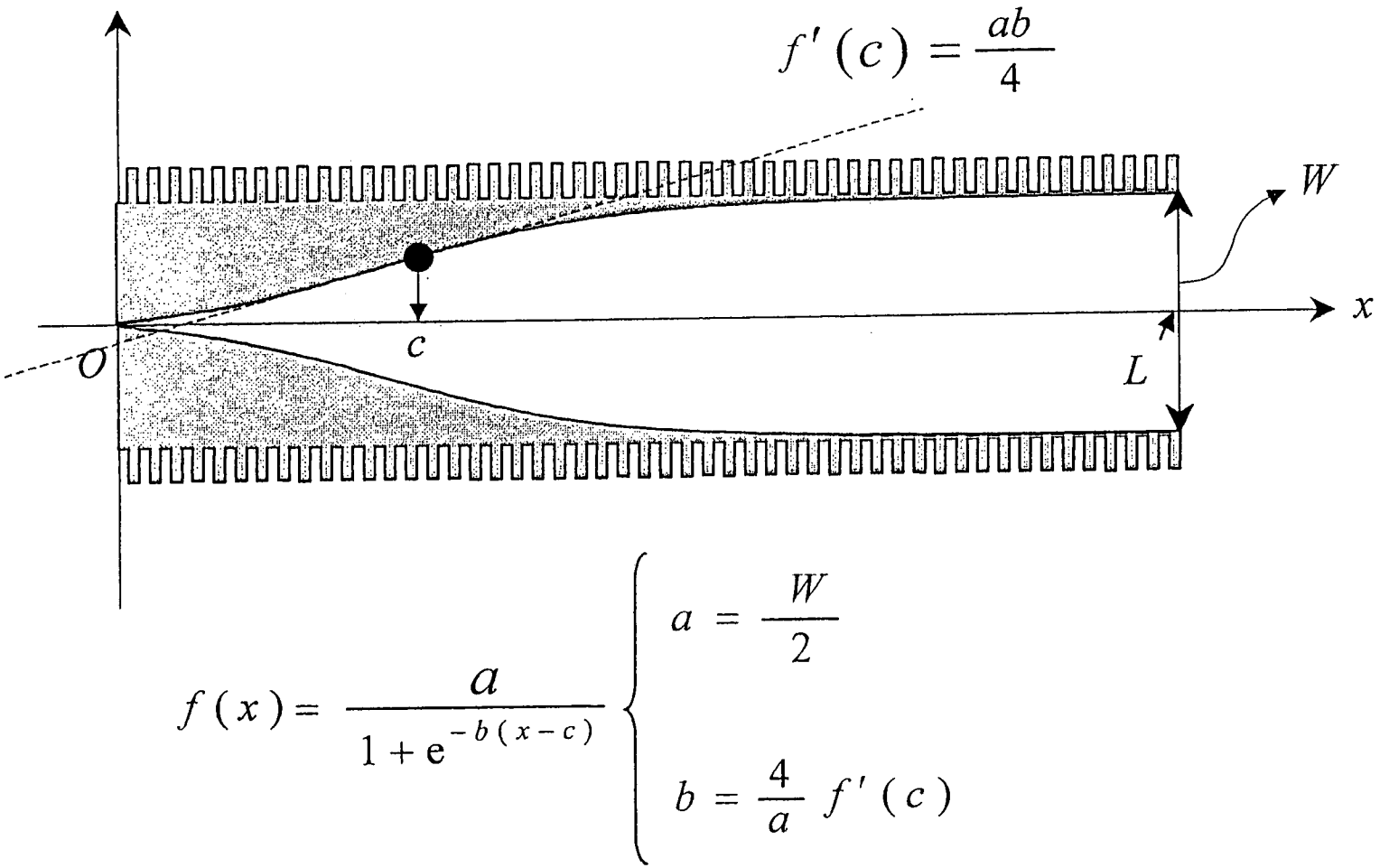
FIG. 10 is a diagram showing tangential gradient at a point of infection in a case when a position of a point of infection of taper shape of the Fermi-antenna was moved to around ¼ of the length of antenna.
Figure 11:
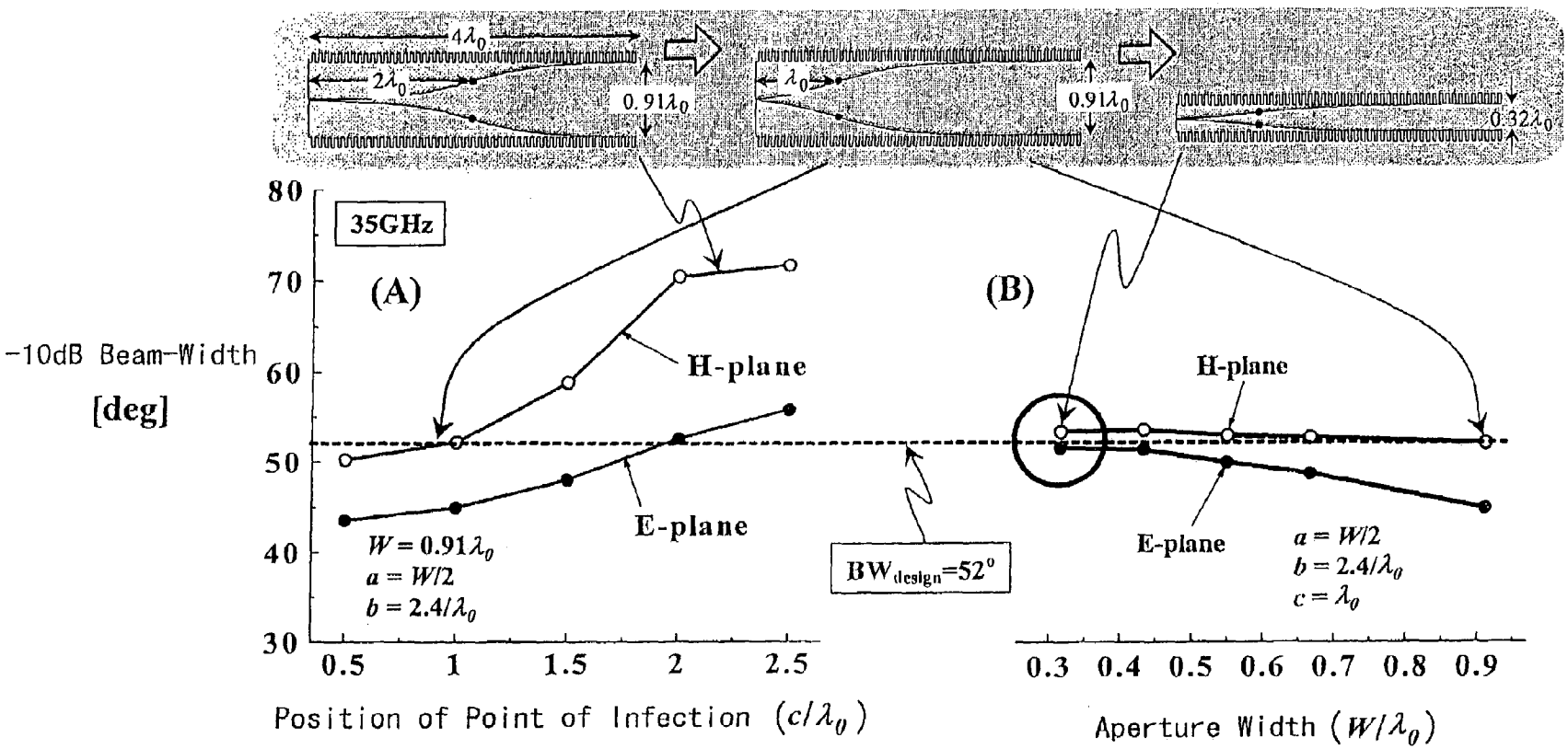
FIGS. 11(A) and 11(B) are diagrams showing the 10 dB beam widths of H-plane and E-plane vs changes of position of a point of infection of Fermi-function of the Fermi-antenna (FIG. 11(A)) and the 10 dB beam widths of H-plane and E-plane vs changes of aperture width of the Fermi-antenna (FIG. 11(B))
Figure 12:
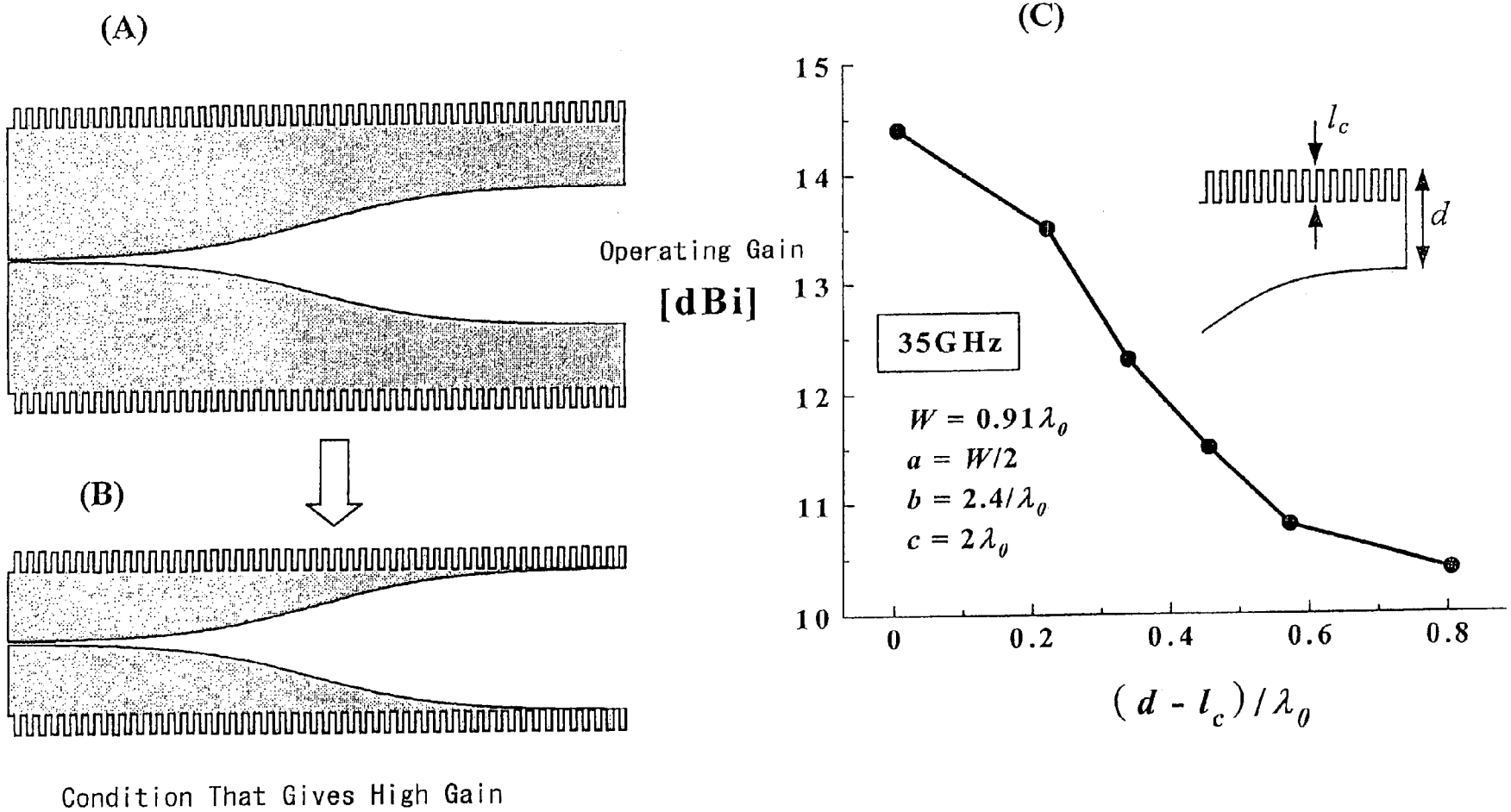
FIG. 12 is a diagram showing operating gains when a difference (d) between the width of substrate (D) of the Fermi-antenna and the aperture width (W) was changed.

An example of the case in which this point of infection was changed is shown in FIG. 10. FIG. 10 is a diagram of the time when the point of infection "c" was shifted to the left direction from the center position of the length of antenna, and this point of infection "c" are largely contributing to the change of the beam width of H-plane. FIG. 11(A) is a diagram showing the 10 dB beam width of the time when the position of point of infection is changed while fixing the aperture width in ($W=0.91\lambda_0$). When the point of infection "c" is decreased from $2\lambda_0$ to $\lambda_0$ the 10 db beam width of H-plane changes from 70.4 degrees to 52 degrees of target value. However, the change of the beam width of E-plane in this time is only 7.5 degrees. Therefore, from this FIG. 11(A), as for the beam width of E-plane, it is understandable that a contribution ratio of the change of the point of infection "c" is comparatively small. In addition, the "a" and "b" are set as $a=W/2$ and $b=2.4/\lambda_0$, in this experiment. Furthermore, though it is described later, FIG. 11(B) is the one that plotted data in a case when the aperture width W was changed without changing the position of the point of infection "c".

Like this, in the flow chart of FIG. 1, the point of infection "c" of the Fermi function is changed in the step S9 and the judgment in the step S8 is executed again, and these steps are repeated until the beam width of H-plane corresponds with the target value ($BW_{design}$=52 degrees). By the repetition of this loop, the beam width of H-plane gradually approaches and fits the target value, and then goes to the next step S10.

In the step S10, the aperture width (W) of the Fermi-antenna is tentatively set up. The width of substrate (D) of the dielectric substrate is set to a value ($D=W+2L_c$) in which two times of the height of corrugation ($L_c$) is added to the aperture width (W). Here, it is explained about the relationship with the width of substrate (D) and the aperture width (W) with reference to FIGS. 12(A) to 12(C), first. FIG. 12(A) is the one showing the taper shape of the Fermi-antenna in a case when the width of substrate is; $D>W+2L_c$, ($d>L_c$). FIG. 12(B) is the one showing the taper shape of the Fermi-antenna in a case when the width of substrate is; $D=W+2L_c$, ($d=L_c$). Also, FIG. 12(C) is the operation gain characteristics that were analyzed by changing the difference between the width of substrate and the aperture width ($D-W=2d$) when the $W=0.91\lambda_0$, $a=W/2$, $b=2.4/\lambda_0$ and $c=2\lambda_0$ are selected. From FIG. 12(C), it is understood that the value of d that becomes maximum gain is $d=L_c$. Therefore, it is set to $D=W+2L_c$ in the case of the decision of the width of substrate (D) in the step S10. Also, the aperture width (W) is set to $0.91\lambda_0$ as an initial value.

Subsequently, it is judged whether or not the beam width of E-plane corresponds with the target value ($BW_{design}$=52 degrees) that was set up in the step S6 (step S11). If it was judged that the beam width of E-plane corresponds with the target value ($BW_{design}$=52 degrees) in this decision step S11, it is ended because the beam width in both of H-plane and E-plane became the target value (step S13). If it was judged that the beam width of E-plane is not equal to the target value ($BW_{design}$=52 degrees) in the decision step S11, the aperture width (W) of the antenna is changed (step S12).

Figure 13:
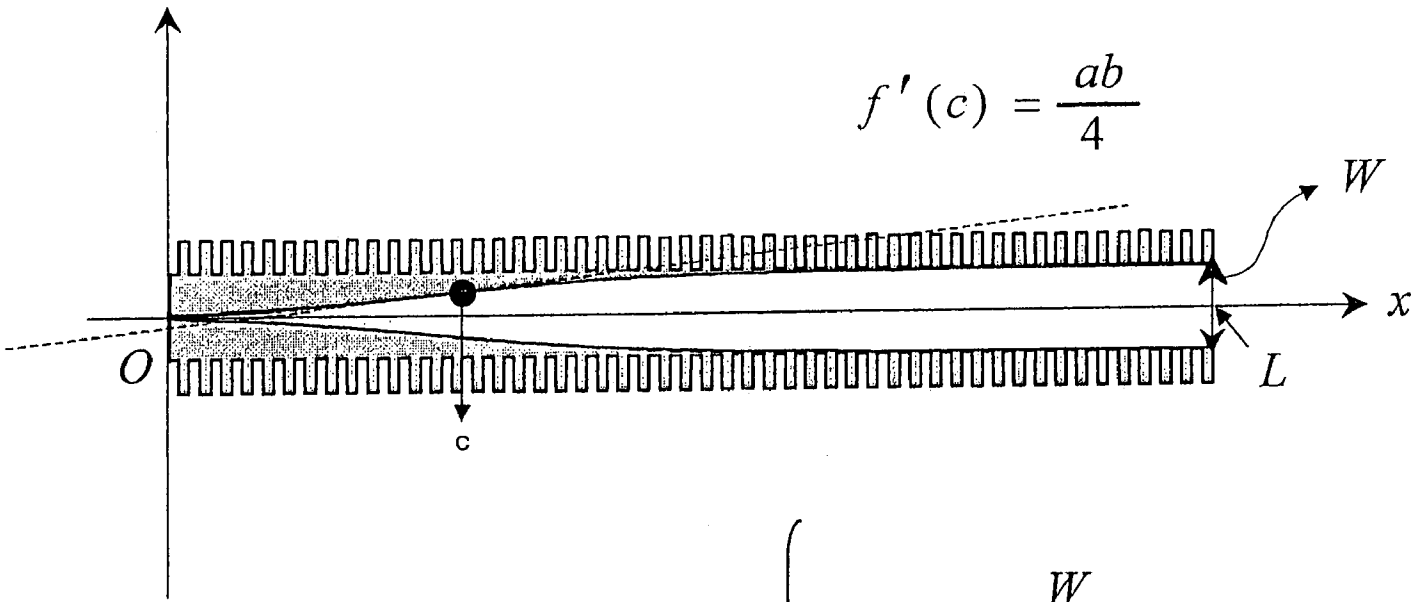
FIG. 13 is a diagram showing a structure of the Fermi-antenna in a case when a position of a point of infection of taper shape of the Fermi-antenna was moved to around ¼ of the length of antenna and furthermore an aperture width was narrowed.
Figure 14:
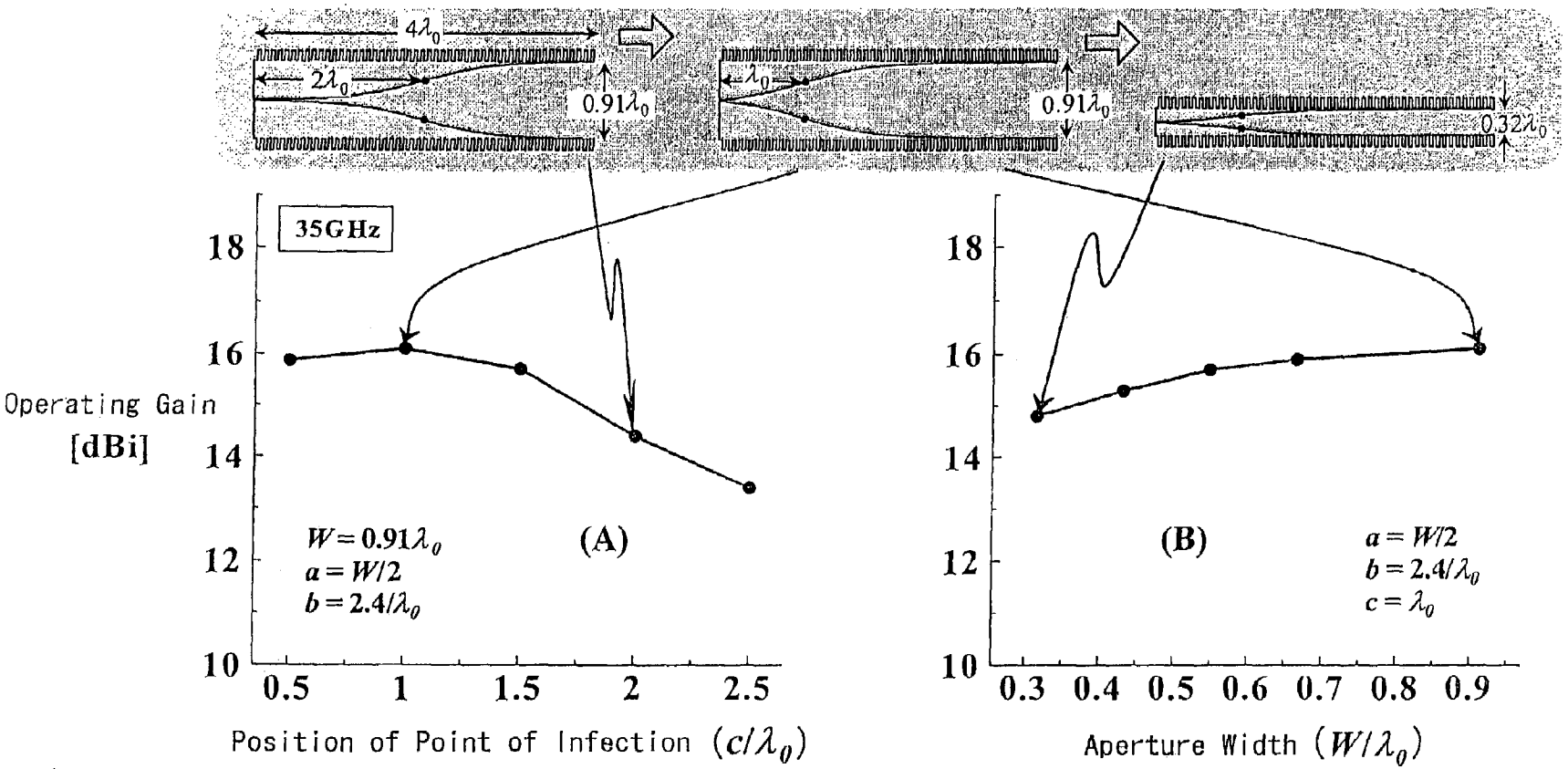
FIGS. 14(A) and 14(B) are diagrams showing the gain characteristic vs changes of position of a point of infection of Fermi-function of the Fermi-antenna (FIG. 14(A)) and the gain characteristic vs changes of aperture width of the Fermi-antenna (FIG. 14(B))
Figure 15:
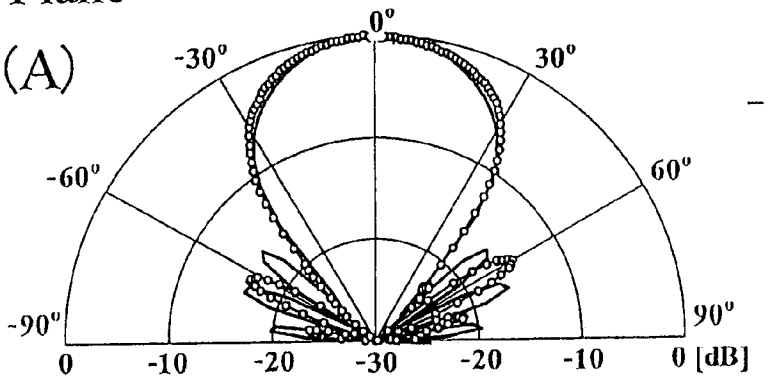
FIGS. 15(A), 15(B) and 15(C) are diagrams in which there are shown directivity of H-plane in FIG. 15(A), the analyzed values and measured values by FDTD method of directivity of E-plane of FIG. 15(B) and frequency characteristic of 10 dB beam width in FIG. 15(C) with respect to a Fermi-antenna designed according to the design method of the present invention.
Figure 15:
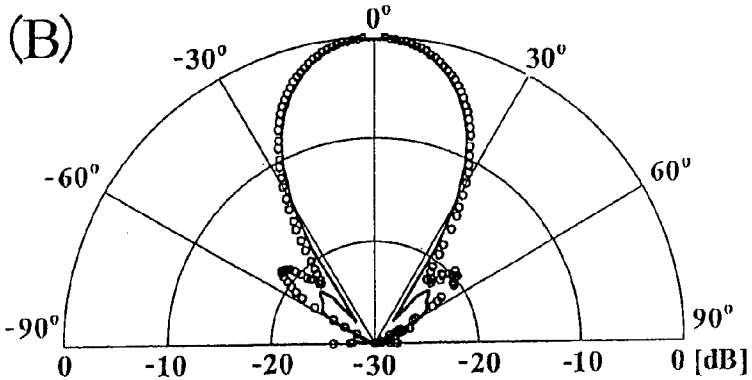
Figure 15:
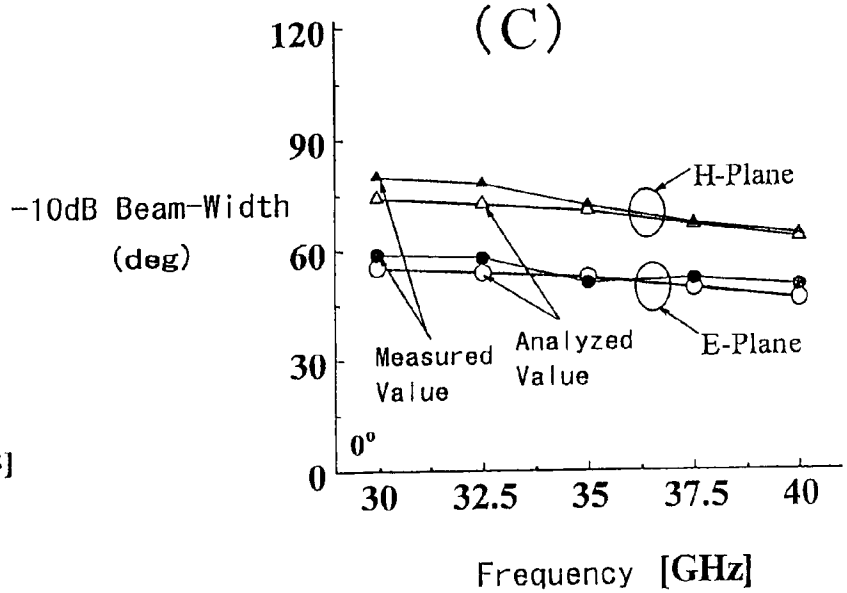
Figure 16:
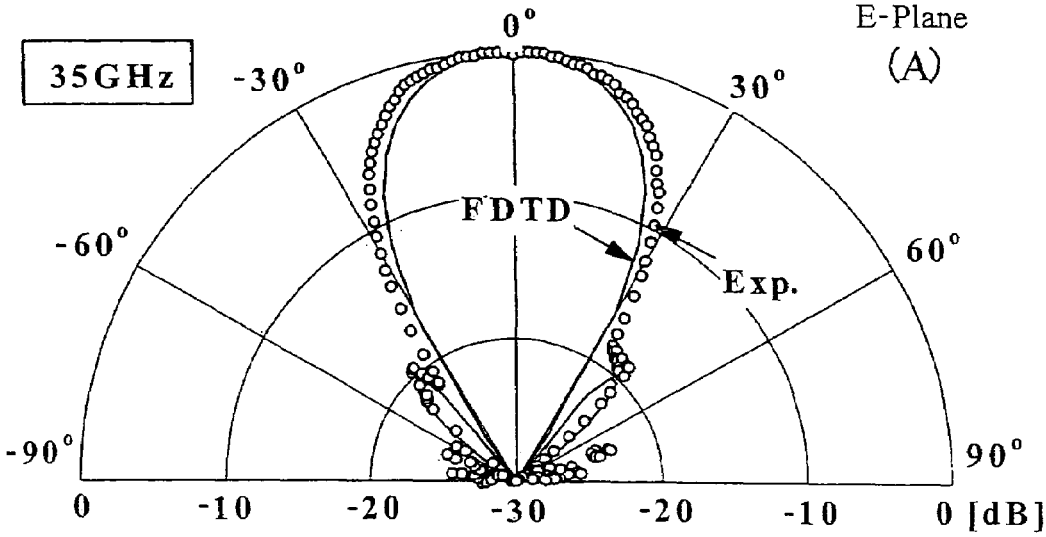
FIGS. 16(A) and 16(B) are diagrams in the design method of the present invention in which there are shown the analyzed values and the measured values of directivity of E-plane in FIG. 16(A) and directivity of H-plane in FIG. 16(B) with respect to the Fermi-antenna designed on an assumption that the aperture width W=0.32λ0 according to the FDTD method.
Figure 16:
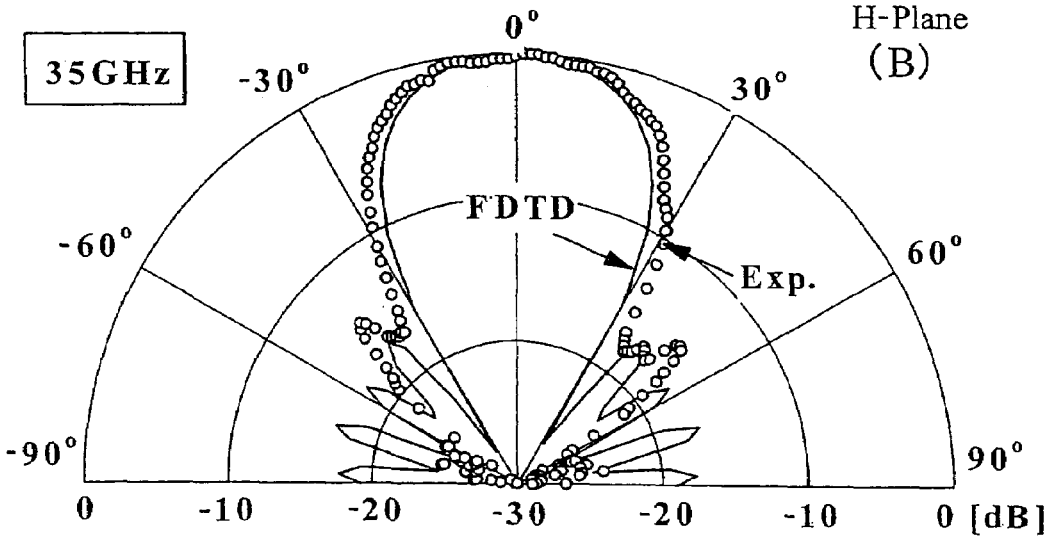
Figure 17:
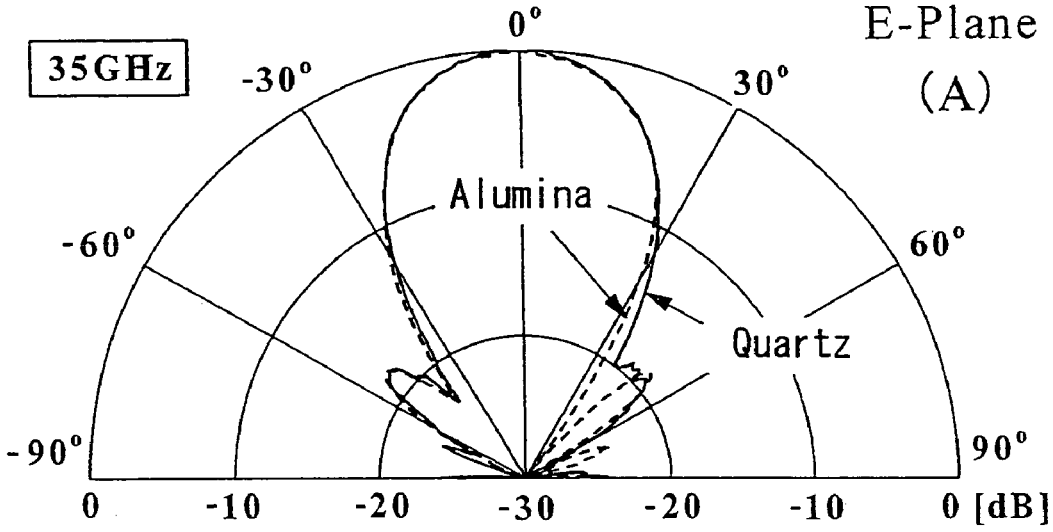
FIGS. 17(A) and 17(B) are diagrams in the design method of the present invention in which there are shown the analyzed values and the measured values of directivity of E-plane in FIG. 17(A) and directivity of H-plane in FIG. 17(B) with respect to the Fermi-antenna designed when effective thickness is made to be the same by changing material and thickness of dielectric substrate according to the FDTD method.
Figure 17:
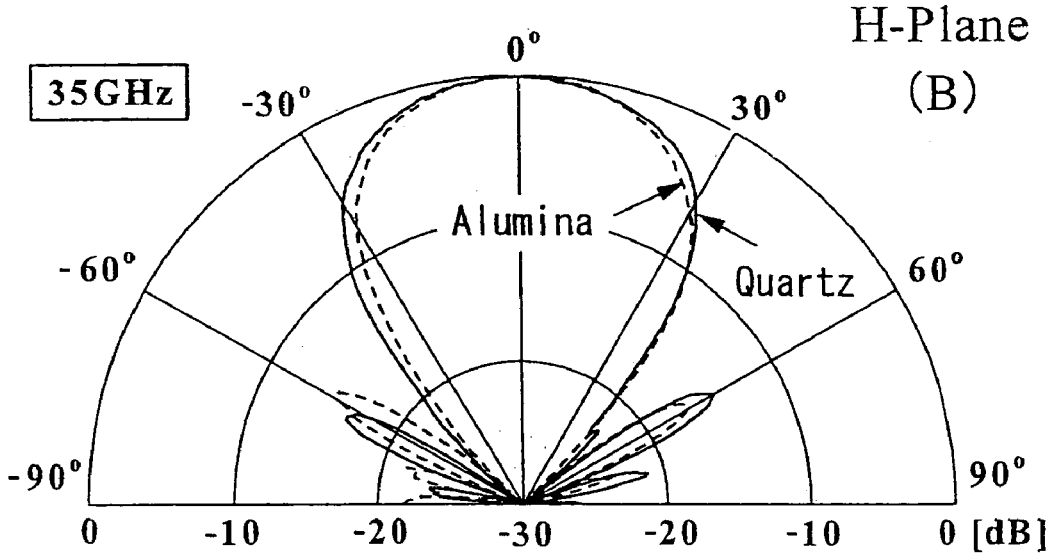

FIG. 13 is a diagram showing the taper shape of the Fermi-antenna of the case that changed the aperture width W (2a) in the condition where the parameters of Fermi function are $b=2.4/\lambda_0$ and $c=\lambda_0$. Also, FIG. 11(B) is the one that plotted the 10 dB beam width of H-plane and E-plane when the aperture width W was changed, in the condition where the parameters (b and c) were set to the fixed values. The beam width of E-plane changes until the target value ($BW_{design}$=52 degrees), by decreasing the aperture width W from $0.91\lambda_0$ to $0.32\lambda_0$. however, in this time, the change of the beam width of H-plane is only 1.2 degrees and it is understood that it is maintaining a constant value approximately without depending on the change of the aperture width.

As mentioned above, FIG. 11(A) shows that the change of the point of infection (c) gives a large influence to the beam width of H-plane and gives a little influence to the beam width of E-plane, and FIG. 11(B) shows that the change of the aperture width (W) gives a large influence to the beam width of E-plane and gives a little influence to the beam width of H-plane. From these results, it can say that the beam widths of H-plane and E-plane can be adjusted by changing the values of the position of point of infection (c) and aperture width (W), respectively independently. Therefore, in the design method of this invention, by using these characteristics, the beam widths of H-plane and E-plane are made to be independent and to accord with the target value ($BW_{design}$=52 degrees).

FIG. 14(A) is a graph showing the operating gain of the time when the position of point of infection (c) of the Fermi function is changed, and FIG. 14(B) is a graph showing the operating gain of the time when the aperture width of the Fermi function is changed. As understood from this FIG. 14(A), the gain can be made high if the position of point of infection is moved to the left direction without changing the aperture width, namely if the c is decreased. Also, from FIG. 14(B), even if the aperture width (W) is decreased from $0.91\lambda_0$ to $0.32\lambda_0$, it is understood the gain that decreases is a little, about 1 dB.

FIG. 15(A) to 15(B) are diagrams in which there are plotted the operating gain patterns of: the measured values (circles) of the time when the thermal noise radiated from the object was measured by using the Fermi-antenna designed by the above-mentioned method; and the analyzed values (solid line) by the FDTD method. FIG. 15(A) shows the operating gain pattern of H-plane and FIG. 15(B) shows the operating gain pattern of E-plane and FIG. 15(C) shows the frequency characteristic of the 10 dB beam width. By seeing these diagrams, it is understood that the beam width of H-plane is wider than the beam width of E-plane. Also, as understood from FIG. 15(C), it can say that as for the measured values and the analyzed values by the FDTD, at the border of near 35 GHz, the index of accordance increases when the frequency increases and, the difference increases when the frequency decreases.

FIGS. 16(A) and 16(B) are diagrams in which there are plotted operating patterns of: the measured values (circles) of the time when the thermal noise was measured by using the Fermi-antenna in which the aperture width (W) was designed as $0.32\lambda_0$; and also the analyzed values (solid line) by the FDTD method. As it is apparent from this figure, by making the aperture width to be $032\lambda_0$, it is understood that the indexes of accordance of the directivity patterns of both of E-plane (FIG. 16(A)) and H-plane (FIG. 16(B)) become high, and the circular directivities are realized. Further, it is also understood that the experimental measured values and the analyzed values are corresponded with very well.

Also, FIGS. 17(A) and 17(B) are the diagrams that plotted the operating patterns of: the measured values (solid line) of the case which uses quartz (h=200 μm); and the measured values (dotted line) of the case which uses alumina (h=100 μm), when two kinds of the dielectric substrate are used and those effective thicknesses are the same. It was understood that the directivities of both of the E-plane (FIG. 17(A)) and the H-plane (FIG. 17(B)) are corresponded with very well. As it is apparent from this experimental result, it was recognized that the extremely near operating gain pattern can be obtained by making the effective thicknesses equal, even if the material of dielectric substrate was changed.

Figure 18:
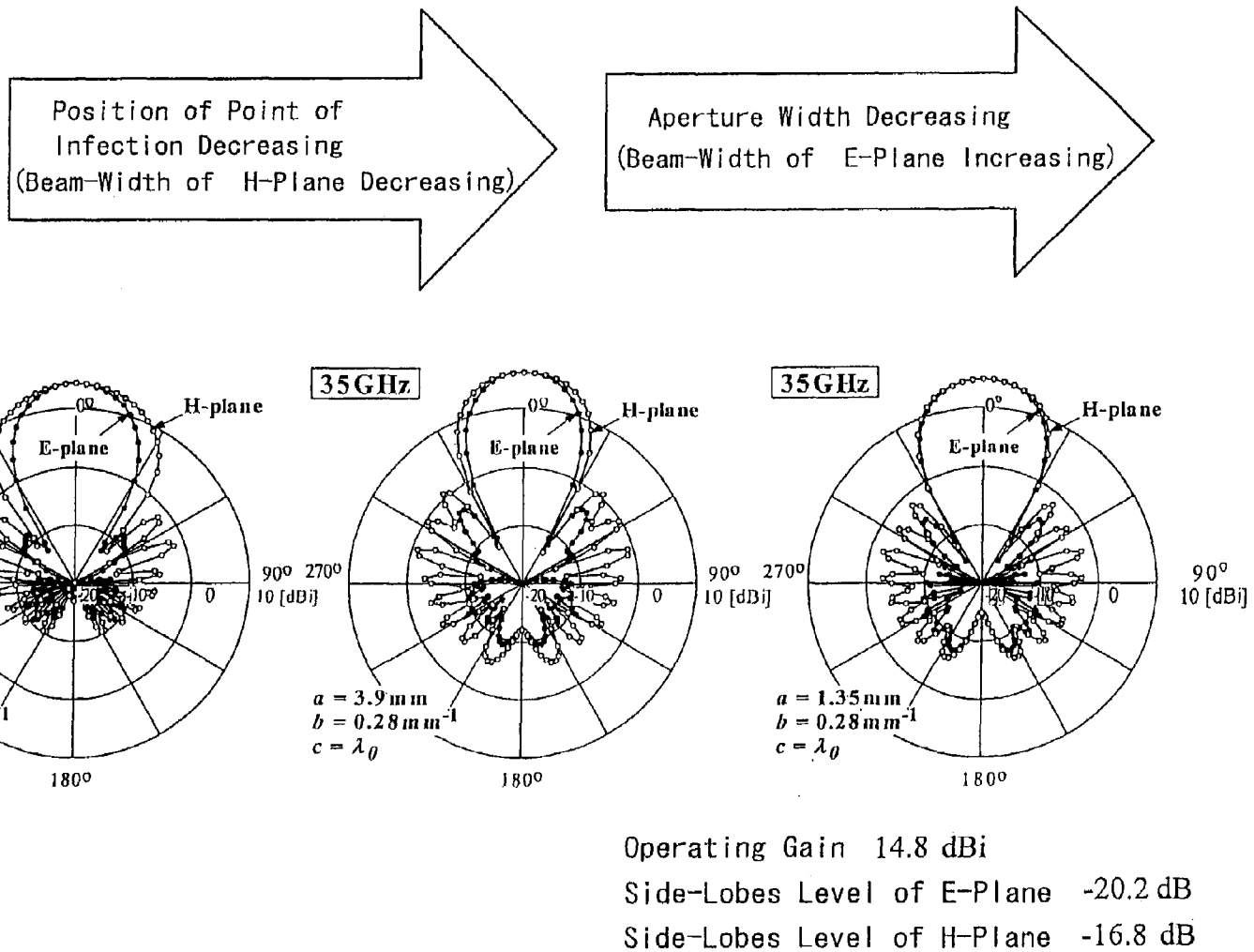
FIG. 18 is a diagram showing operating gain patterns for explaining in the design method of the present invention that beam width of H-plane is changed by changing the position of a point of infection and beam width of E-plane is changed by changing aperture width.

FIG. 18 is a diagram showing the changes of the operating gain patterns versus the changes of the positions of point of infection (c) and widths of aperture (W) of the Fermi-antenna that is obtained by the above-mentioned design procedures. As it is apparent from this FIG. 18 and the FIG. 11 explained above, because the beam width of H-plane is decreased by decreasing the position of point of infection (c) and the beam width of E-plane is increased by decreasing the aperture width in the 35 GHz-band, it is understood that the beam width of H-plane and beam width of E-plane become extremely near operating gain patterns.

Figure 19:
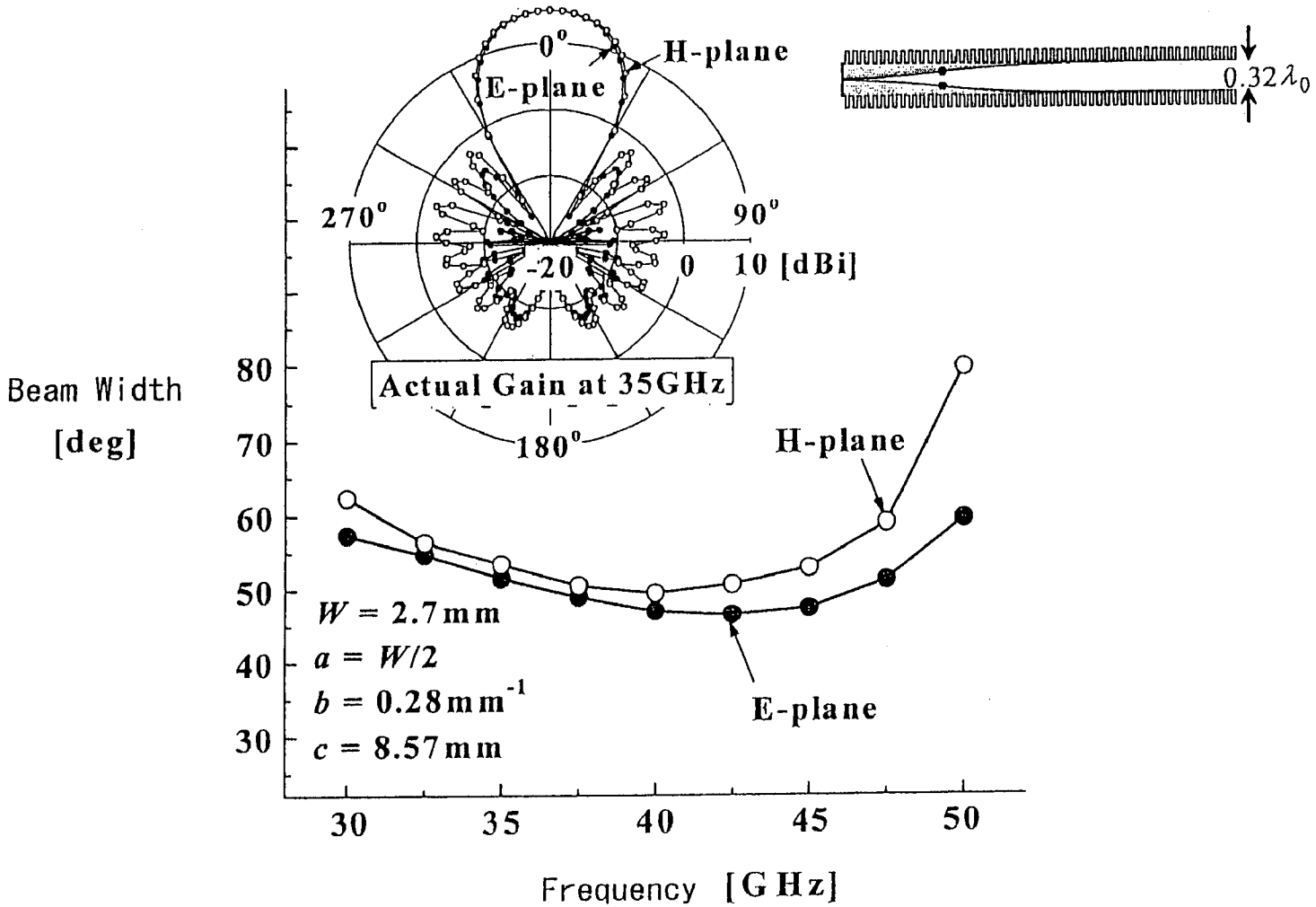
FIG. 19 is a diagram showing frequency characteristic of 10 dB beam width and operating gain patterns with respect to a Fermi-antenna designed according a design method of the present invention.

Also, FIG. 19 is a graph that plotted the relationship with the frequency of the Fermi-antenna designed by such design procedures mentioned above and the 10 dB-beam width. As understood from this figure, the beam widths of H-plane and E-plane are approximately equal over the wide frequency band from 32.5 GHz to 40 GHz. Like this, the 10 dB beam width of the Fermi-antenna designed by the design method of the present invention has a characteristic of the broadband, and the gain 14.8 dBi and the axis symmetrical directivities with the Levels of side-lobes of E-plane and H-plane −20.1 dB and −16.8 dB respectively are obtained.

Figure 20:
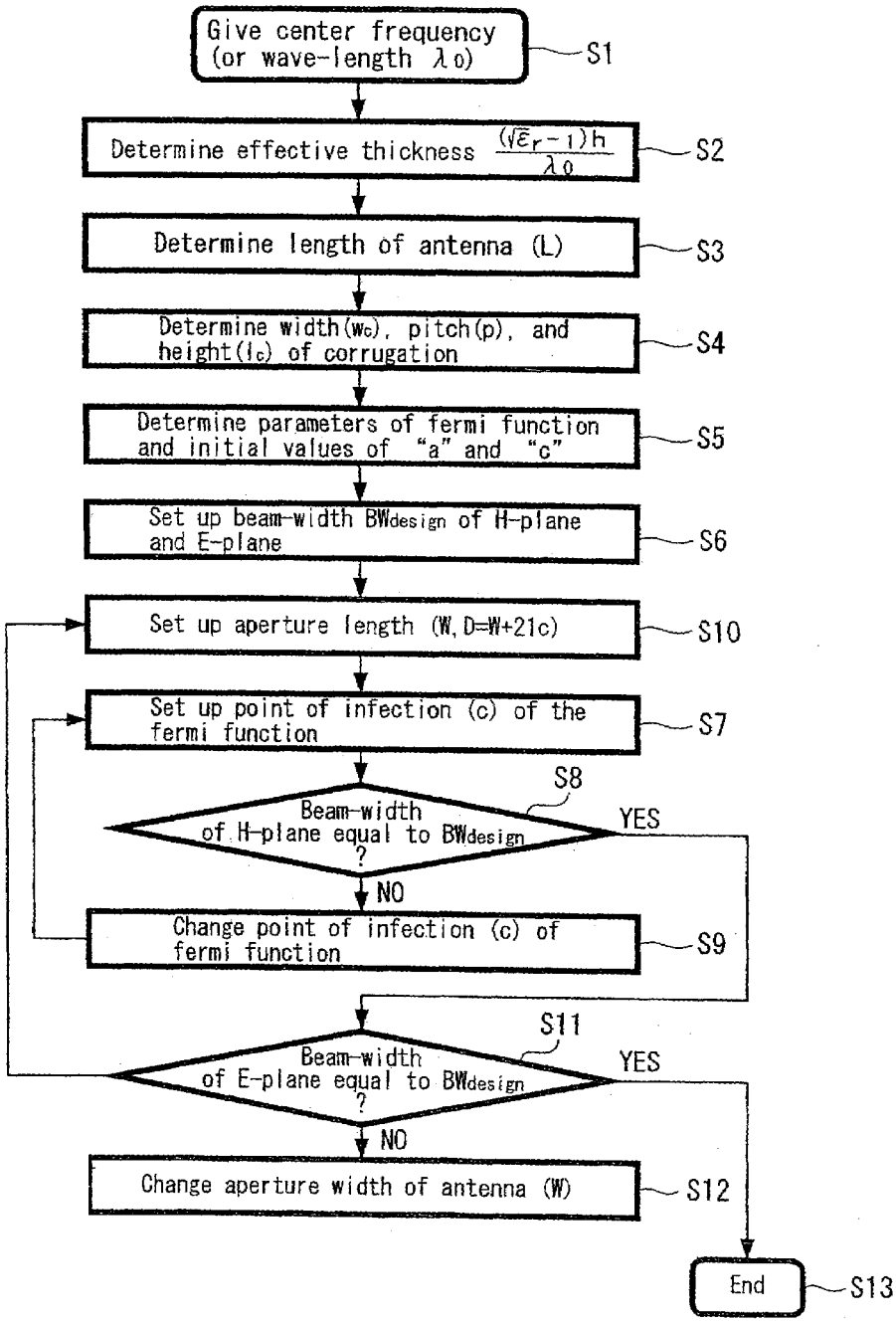
FIG. 20 is a flow chart showing a design method and program of a Fermi-antenna of another embodiment according to the present invention.
Figure 21:
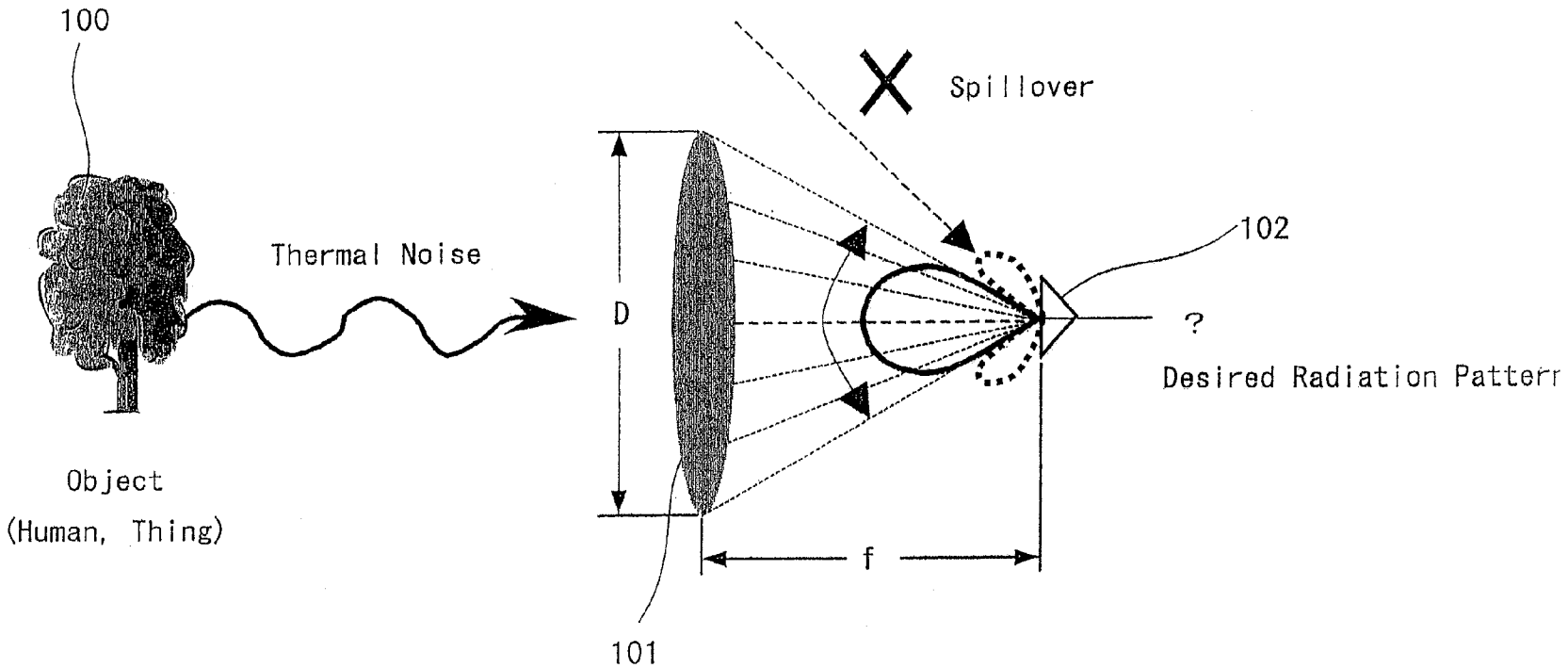
FIG. 21 is a diagram showing principle of passive imaging of millimeter-wave in the past schematically.
Figure 22:
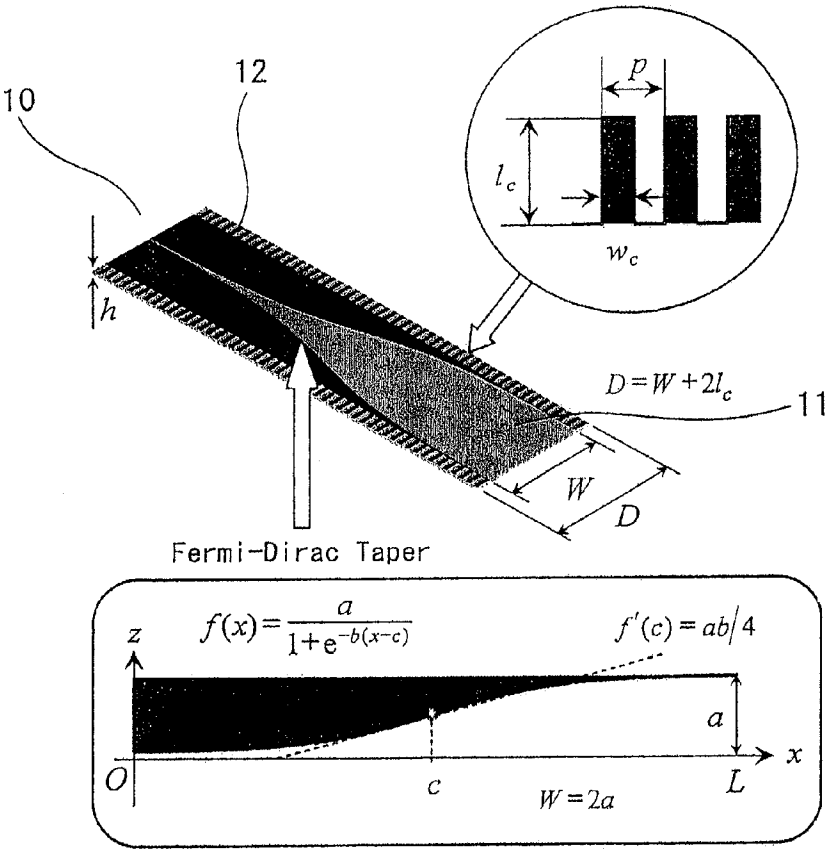
FIG. 22 is a diagram showing structure and principle of the Fermi-antenna.

Next, another embodiment of the design method of the Fermi-antenna according to the present invention is explained with reference to FIG. 20. The same numerals of step are given to the same portions as ones of the flow chart of FIG. 1. The portions that differ from the embodiment shown in FIG. 1 are that; after having set up the target value $BW_{design}$ of the beam widths of H-plane and E-plane in the step S6, the aperture width (W, D) is set up in the step S10. Then, if it was judged that the beam width of E-plane is not equal to $BW_{design}$ in the step S11, the aperture width of the antenna is changed (step S12) and it again returns to the S10. In this design method, because the loop of decision process of the beam width of H-plane is entered into the loop of decision process of the beam width of E-plane, there is a possibility that the beam width of H-plane depends on the beam width of E-plane (aperture width) usually and is affected. However, as understood from FIG. 11(B), because the beam width of H-plane is maintaining almost constant value even if the aperture width is changed, the Fermi-antenna in which the radiation directivities of E-plane and H-plane are equal can be designed even by such design method, as the same as the flow chart in FIG. 1.

As mentioned above, by using the design method and design program of the Fermi-antenna according to the present invention, the radiation patterns of E-plane and H-plane can be made to be the same patterns in comparative short time by the regular procedures. Also, the antenna can be made to have the high gains in both of E-plane and H-plane, and also to have the desired beam width, and the side-lobes can also be set to the low level, therefore, the Fermi-antenna that is suitable for the receiving element for millimeter-wave imaging can be realized.

In addition, the design method and design program of the Fermi-antenna of the present invention is not limited to the embodiments that were mentioned above.

The invention claimed is:

1. In a design method of a Fermi-antenna with corrugation that has a broadband and circular directivity which are necessary for the reception imaging of millimeter-wave, a design method of a Fermi-antenna comprising the steps of:

setting an H-plane beam width to be a beam width having a directivity of target by changing a point of infection of a Fermi-Dirac function that is a taper function of said Fermi-antenna; and setting an E-plane beam width to be said beam width having the directivity of target by changing an aperture width of said Fermi-antenna, wherein wideband and circular directivity are realized.

2. In a design method of a Fermi-antenna with corrugation that has a broadband and circular directivity which are necessary for the reception imaging of millimeter-wave, a design method of a broadband Fermi-antenna comprising the steps of:

a step which gives a center frequency of broadband frequencies or a corresponding wave-length;

a step which determines an effective thickness of a dielectric substrate of said Fermi-antenna;

a step which determines a length of antenna of said Fermi-antenna;

a step which determines a width, pitch and height of said corrugation of said Fermi-antenna;

a step which determines parameters of Fermi-Dirac function that form a taper shape of said Fermi-antenna;

a step which sets up target values of beam widths of an H-plane and E-plane of an electromagnetic-wave that is radiated from said Fermi-antenna;

an H-plane beam width comparative step which compares said H-plane beam width with said preset target value of H-plane beam width after a point of infection of said Fermi-antenna was set optionally;

an H-plane beam width decision cycle which repeats again the step that compares said H-plane beam width with said preset target value of H-plane beam width after having changed a position of the point of infection when it does not accord with said target value in said H-plane beam width comparative step;

a step which sets up an aperture width of said Fermi-antenna when the H-plane beam width has accorded with the preset H-plane beam width in said H-plane beam width comparative step;

an E-plane beam width comparative step which compares the E-plane beam width of an electromagnetic-wave that is radiated on the basis of said set aperture width with said preset target value of E-plane beam width; and an E-plane beam width decision cycle which repeats again the step that compares said E-plane beam width with said preset target value of E-plane beam width by changing the aperture width when it does not accord with said target value in said E-plane beam width comparative step, wherein it is designed so that both of said H-plane beam width and said E-plane beam width have almost equal circular directivities.

3. In a program for designing a Fermi-antenna with corrugation that has a broadband and circular directivity which are necessary to the reception imaging of millimeter-wave, a program for designing a broadband Fermi-antenna executing:

a procedure which gives a center frequency of broadband frequencies or a corresponding wave-length;

a procedure which determines an effective thickness of a dielectric substrate of said Fermi-antenna;

a procedure which determines a length of antenna of said Fermi-antenna;

a procedure which determines a width, pitch and height of said corrugation of said Fermi-antenna;

a procedure which determines parameters of Fermi-Dirac function that form a taper shape of said Fermi-antenna;

a procedure which sets up target values of beam widths of an H-plane and E-plane of an electromagnetic-wave that is radiated from said Fermi-antenna;

a procedure which compares said H-plane beam width with said preset target value of H-plane beam width after a point of infection of said Fermi-antenna was set optionally;

a procedure which repeats the procedure that compares said H-plane beam width with said target value of H-plane beam width after having changed a position of said point of infection when said H-plane beam width does not accord with said target value, and which sets up an aperture width of said Fermi-antenna when the H-plane beam width has accorded with the preset H-plane beam width in said procedure that compares said H-plane beam width;

a procedure which compares the E-plane beam width of an electromagnetic-wave that is radiated on the basis of said set aperture width with said preset target value of E-plane beam width; and a procedure for designing it so that both of said H-plane beam width and said E-plane beam width have almost equal circular directivities, by repeating the procedure which compares said E-plane beam width with said preset target value of E-plane beam width by changing said aperture width in said procedure that compares the E-plane beam width.

4. In a recording medium which recorded a program for designing a Fermi-antenna with corrugation that has a broadband and circular directivity which are necessary for the reception imaging of millimeter-wave, a recording medium recorded with a program for designing a broadband Fermi-antenna which execute:

a procedure which gives a center frequency of broadband frequencies or a corresponding wave-length;

a procedure which determines an effective thickness of a dielectric substrate of said Fermi-antenna;

a procedure which determines a length of antenna of said Fermi-antenna;

a procedure which determines a width, pitch and height of said corrugation of said Fermi-antenna;

a procedure which determines parameters of Fermi-Dirac function that form a taper shape of said Fermi-antenna;

a procedure which sets up target values of beam widths of an H-plane and E-plane of an electromagnetic-wave that is radiated from said Fermi-antenna;

a procedure which compares said H-plane beam width with said preset target value of H-plane beam width after a point of infection of said Fermi-antenna was set optionally;

a procedure which repeats the procedure that compares said H-plane beam width with said target value of H-plane beam width after having changed a position of said point of infection when said H-plane beam width does not accord with said target value, and which sets up an aperture width of said Fermi-antenna when the H-plane beam width has accorded with the preset H-plane beam width in said procedure that compares said H-plane beam width;

a procedure which compares the E-plane beam width of an electromagnetic-wave that is radiated on the basis of said set aperture width with said preset target value of E-plane beam width; and a procedure for designing it so that both of said H-plane beam width and said E-plane beam width have almost equal circular directivities, by repeating the procedure which compares said E-plane beam width with said preset target value of E-plane beam width by changing said aperture width in said procedure that compares the E-plane beam width.

* * * * *

UNITED STATES PATENT AND TRADEMARK OFFICE

CERTIFICATE OF CORRECTION

PATENT NO. : 7,629,936 B2
APPLICATION NO. : 11/514642
DATED : December 8, 2009
INVENTOR(S) : Mizuno et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 605 days.

Signed and Sealed this

Second Day of November, 2010

David J. Kappos

David J. Kappos
*Director of the United States Patent and Trademark Office*